US010954878B2

(12) United States Patent
Kang et al.

(10) Patent No.: US 10,954,878 B2
(45) Date of Patent: Mar. 23, 2021

(54) VIBRATION REDUCTION DEVICE UPON KEY-OFF OF ENGINE AND METHOD THEREOF

(71) Applicants: Hyundai Motor Company, Seoul (KR); Kia Motors Corporation, Seoul (KR)

(72) Inventors: Young-Koo Kang, Hwaseong-si (KR); Su-Young Park, Uiwang-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 35 days.

(21) Appl. No.: 16/184,882

(22) Filed: Nov. 8, 2018

(65) Prior Publication Data

US 2019/0277219 A1 Sep. 12, 2019

(30) Foreign Application Priority Data

Mar. 7, 2018 (KR) ..... 10-2018-0026933

(51) Int. Cl.
*F02D 41/38* (2006.01)
*F02D 41/22* (2006.01)

(52) U.S. Cl.
CPC ..... *F02D 41/3809* (2013.01); *F02D 41/22* (2013.01); *F02D 2041/226* (2013.01); *F02D 2041/389* (2013.01); *F02D 2200/101* (2013.01); *F02D 2200/1002* (2013.01); *F02D 2250/18* (2013.01); *F02D 2250/28* (2013.01)

(58) Field of Classification Search
CPC ..... F02D 41/22; F02D 41/38; F02D 41/3809; B60K 41/04
USPC ..... 701/101–105, 111–115
See application file for complete search history.

(56) References Cited

U.S. PATENT DOCUMENTS 4,351,289 A * 9/1982 Renda ..... F02D 19/12 123/25 A
5,445,128 A * 8/1995 Letang ..... B60K 31/045 123/436
5,657,229 A * 8/1997 Naito ..... B60T 8/175 701/71

(Continued)

FOREIGN PATENT DOCUMENTS

KR 10-2004-0008801 A 1/2004
KR 10-0489069 B1 5/2005
KR 10-0980886 B1 9/2010

*Primary Examiner* — John Kwon
*Assistant Examiner* — Johnny H Hoang
(74) *Attorney, Agent, or Firm* — Morgan, Lewis & Bockius LLP

(57) ABSTRACT

A vibration reduction device upon KEY-OFF of an engine may include a fuel injection device for injecting fuel stored in a fuel tank into a combustion chamber of an engine depending upon a target torque value, a measurement device for measuring the RPM and the rotational torque of the engine, and an controller for detecting whether or not an engine becomes KEY-OFF and when it is determined to be in KEY-OFF state, setting a reference torque value, and setting a torque value changing the reference torque value depending upon a predetermined reference as the target torque value and controlling the fuel injection device to finely inject fuel into the engine depending upon the target torque, thus reducing engine vibration.

18 Claims, 19 Drawing Sheets

(56) References Cited

U.S. PATENT DOCUMENTS

| | | | | |
|---|---|---|---|---|
| 5,759,133 | A * | 6/1998 | Treinies | B60G 17/018 477/110 |
| 5,952,564 | A * | 9/1999 | Naito | B60T 8/173 73/115.01 |
| 2004/0249553 | A1* | 12/2004 | Liskow | F02D 41/0085 701/104 |
| 2007/0163547 | A1* | 7/2007 | Nakasaka | F02D 13/0207 123/478 |
| 2009/0099755 | A1* | 4/2009 | Harbert | F02D 41/0087 701/103 |
| 2009/0165446 | A1* | 7/2009 | Haseyama | F01N 3/02 60/286 |
| 2010/0031923 | A1* | 2/2010 | Weng | F02D 35/027 123/406.24 |
| 2010/0280742 | A1* | 11/2010 | Gwidt | F02D 41/22 701/103 |
| 2011/0166769 | A1* | 7/2011 | Buechler | F02D 23/00 701/103 |
| 2011/0259440 | A1* | 10/2011 | Kawashima | B63B 1/38 137/234.6 |
| 2015/0039207 | A1* | 2/2015 | Oryoji | F02D 35/023 701/103 |
| 2016/0153520 | A1* | 6/2016 | Yun | F02D 41/021 701/103 |
| 2017/0356353 | A1* | 12/2017 | Rollinger | F02D 13/06 |
| 2017/0356374 | A1* | 12/2017 | Rollinger | F02D 41/3005 |
| 2018/0003139 | A1* | 1/2018 | Salazar | F02D 41/2096 |
| 2018/0058367 | A1* | 3/2018 | Ottikkutti | F02D 41/403 |

* cited by examiner

LATERAL VIBRATION CONTROL BASED ON TIMER (500ms)

LATERAL VIBRATION CONTROL BASED ON TIMER (800ms)

LATERAL VIBRATION CONTROL BASED ON RPM OF ENGINE (500ms)

VERTICAL VIBRATION BEFORE VIBRATION CONTROL

VERTICAL VIBRATION CONTROL BASED ON TIMER (500ms)

VERTICAL VIBRATION CONTROL BASED ON TIMER (800ms)

VERTICAL VIBRATION CONTROL BASED ON RPM OF ENGINE

VIBRATION REDUCTION DEVICE UPON KEY-OFF OF ENGINE AND METHOD THEREOF

CROSS-REFERENCE(S) TO RELATED APPLICATIONS

The present application claims priority to Korean Patent Application No. 10-2018-0026933, filed on Mar. 7, 2018, the entire contents of which is incorporated herein for all purposes by this reference.

BACKGROUND OF THE DISCLOSURE

Field of the Disclosure

The present invention relates to a vibration reduction device and a vibration reduction method upon KEY-OFF of an engine, and more particularly, to a device and a method for reducing vibration generated between the timing when the ignition key of an engine in a commercial vehicle is turned off and the timing when fuel supply is stopped to finally stop the engine.

Description of Related Art

When the ignition key of an engine in a vehicle is turned off, as illustrated in FIG. 7A, the target torque value and the fuel injection amount of the engine are set to zero at the corresponding timing, such that the fuel supply to all the cylinders of the engine is sequentially stopped. However, as illustrated in FIG. 7A, unlike the fuel injection amount or the target torque value, the value of the RPM of the engine does not become 0 immediately upon the KEY-OFF and gradually decreases with a time. This is because the piston in the cylinder of the engine keeps the inertia movement for a predetermined time despite the stop of the fuel supply. There is a problem in that the engine vibration is caused by the piston movement, and when the engine vibration becomes large, a vehicle body is severely vibrated to thereby occur noise.

Accordingly, to prevent the above, a device configured for blocking intake air in an intake manifold through which intake air is introduced is conventionally provided, and by gradually stopping the engine using a method of blocking the intake air when the ignition key is turned off, a method of reducing vibration generated when the ignition key is turned off is used.

However, in the method of blocking the intake air for reducing vibration, the vibration reduction effect is reduced due to leakage between the intake manifold and a throttle valve upon blocking of the intake air, and in addition, when suddenly blocking the intake air during the vehicle driving due to malfunction of the intake air blocking system, problems such as a vehicle accident, inability to travel, excessive graphite occurrence during traveling, etc. are caused. Furthermore, there is a problem in that as components such as a solenoid valve for negative pressure control, a negative pressure hose, etc. are added, it complicates its construction and increases the cost.

To solve the problems, the vibration occurrence is minimized upon stop of the engine by changing the fuel block timing for each cylinder when the ignition key is turned off in a multi-cylinder diesel engine vehicle. However, the method of simply delaying only the fuel injection stop time when the ignition key is turned off can cause a problem of conflicting with the torque control method of the existing vehicle, and in addition, could not be an effective countermeasure against the vibration occurrence problem.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a method configured for more reliably reducing the vibration occurrence due to the engine stop by finely injecting fuel depending upon a target torque value from the KEY-OFF to the timing when the rotational torque of the engine becomes zero even after the ignition key is turned off.

For solving the above problems, the present invention sets as a target torque value the torque value reducing a reference torque value upon the KEY-OFF in which the ignition key is turned off depending upon a predetermined reference, and finely injects fuel to achieve the corresponding target torque value, thus reducing vibration occurrence due to the engine stop.

More specifically, a vibration reduction device upon KEY-OFF of an engine in accordance with various aspects of the present invention for solving the problems may include a fuel injection device configured for injecting fuel stored in a fuel tank into a combustion chamber of an engine depending upon a target torque value; a measurement device configured for measuring the RPM and the rotational torque of the engine; and an engine control device configured for detecting whether or not an engine becomes KEY-OFF and when it is determined to be in KEY-OFF state, setting a reference torque value; and setting a torque value changing the reference torque value depending upon a predetermined reference as the target torque value and controlling the fuel injection device to finely inject fuel into the engine depending upon the target torque, thus reducing engine vibration.

The engine control device performs a vibration reduction control based on the RPM of the engine that sets as the target torque the value reducing the rotational torque value of the engine measured upon the KEY-OFF at a predetermined rate depending upon the RPM of the engine measured from the measurement device.

The engine control device performs a vibration reduction control based on a timer that sets as the target torque the value reducing the rotational torque value of the engine measured upon the KEY-OFF at a predetermined rate depending upon the elapsed time after the KEY-OFF of the engine.

The engine control device measures the RPM of the engine upon the KEY-OFF of the engine by the measurement device, and when the measured RPM of the engine exceeds a predetermined reference value, performs the vibration reduction control.

The engine control device performs a vibration reduction control based on the RPM of the engine that sets as the target torque the value reducing the rotational torque value of the engine measured upon the KEY-OFF at a predetermined rate depending upon the RPM of the engine until the RPM of the engine measured by the measurement device maintains more than a predetermined RPM, and performs a vibration reduction control based on a timer that sets as the target torque the value reducing a final target torque value set upon the vibration reduction control based on the RPM of the engine at a predetermined rate depending upon the elapsed time after the RPM of the engine is equal to or smaller than a predetermined RPM depending upon the vibration reduction control based on the RPM of the engine.

The set target torque value is interpolated by a predetermined interpolation method and a fine injection control of the fuel is performed based on the interpolated target torque value so that a continuous control for the fine injection of the fuel based on the target torque value is possible.

The engine control device confirms a setting value as to whether or not a fuel injection stop timing is delayed upon the KEY-OFF; when it is set to be configured to delay the fuel injection stop timing, performs the vibration reduction control of the engine before stopping the engine; and when it is set to be unable to delay the fuel injection stop timing, sets a target torque amount to zero and stops fuel supply to stop the engine.

The engine control device does not perform the vibration reduction control of the engine when it is diagnosed that the failure of the fuel injection device occurs, and sets a target torque amount to zero and stops fuel supply to stop the engine.

The engine control device determines whether or not a power take-off device disposed on a transmission of a vehicle is in use upon the KEY-OFF; when the power take-off device is in use, does not perform the vibration reduction control of the engine; and sets a target torque amount to zero and stops fuel supply to stop the engine.

A vibration reduction method upon KEY-OFF of an engine in accordance with various aspects of the present invention for solving the problems may include determining whether or not an engine becomes KEY-OFF; measuring the torque of the engine upon the KEY-OFF of the engine when the KEY-OFF of the engine is determined; setting as a target torque the torque reducing the rotational torque value of the engine at a predetermined rate based on the rotational torque value of the engine measured upon the KEY-OFF; and controlling a fuel injection device to finely inject fuel after the KEY-OFF of the engine depending upon the set target torque.

The setting the target torque may include measuring the RPM of the engine using a measurement device, and setting as the target torque the value reducing the rotational torque value of the engine measured upon the KEY-OFF at a predetermined rate depending upon the RPM of the engine; and the fine injection control of the fuel is performed until the target torque set depending upon the RPM of the engine becomes a predetermined value.

The setting the target torque may include counting the elapsed time after the KEY-OFF, and setting as the target torque the value reducing the rotational torque value of the engine measured upon the KEY-OFF at a predetermined rate depending upon the counted time; and the fine injection control of the engine is performed until the target torque set depending upon the elapsed time after the KEY-OFF becomes a predetermined value.

The setting the target torque may include measuring the RPM of the engine using a measurement device, and measuring the RPM of the engine upon the KEY-OFF of the engine by the measurement device and setting as the target torque the value reducing the rotational torque value of the engine measured upon the KEY-OFF at a predetermined rate depending upon the measured RPM of the engine when the measured RPM of the engine exceeds a predetermined reference value; and the fine injection control of the engine is performed based on the set target torque until the target torque set depending upon the RPM of the engine becomes a predetermined value.

The setting the target torque value may include measuring the RPM of the engine using a measurement device, measuring the RPM of the engine upon the KEY-OFF of the engine by the measurement device and counting the elapsed time after the KEY-OFF when the measured RPM of the engine is equal to or smaller than a predetermined reference value, and setting as the target torque the value reducing the rotational torque value of the engine measured upon the KEY-OFF at a predetermined rate depending upon the counted time; and the fine injection control of the engine is performed based on the set target torque until the target torque set depending upon the elapsed time after the KEY-OFF becomes a predetermined value.

The setting the target torque may include measuring the RPM of the engine using a measurement device, setting as the target torque the value reducing the rotational torque value of the engine measured upon the KEY-OFF at a predetermined rate depending upon the measured RPM of the engine until the RPM of the engine becomes equal to or smaller than a predetermined reference value, and setting as the target torque the value reducing the target torque value finally set previously at a predetermined rate depending upon the elapsed time from when the RPM of the engine becomes equal to or smaller than a predetermined reference value; and the fine injection control of the engine is performed based on the set target torque until the target torque set after the KEY-OFF becomes a predetermined value.

The vibration reduction method upon the KEY-OFF of the engine may further include performing a fine injection control of the fuel based on an interpolated target torque value after interpolating the set target torque value by a predetermined interpolation method.

The vibration reduction method upon the KEY-OFF of the engine may further include determining whether or not a fuel injection stop timing may be delayed upon the KEY-OFF, and when it is determined that the fuel injection stop timing is unable to be delayed upon the KEY-OFF, a target torque amount is set to zero and fuel supply is stopped to stop the engine.

When the failure in a fuel injection device has occurred or a power take-off device disposed on a transmission of a vehicle upon the KEY-OFF is in use, it is determined that the fuel injection stop timing is unable to be delayed.

According to the control method of the present invention, the time to stop the engine is increased by about 0.5 second as compared with the case that stops the engine through the sudden closing of the throttle valve and the stop of the fuel supply upon the KEY-OFF of the engine, but the vibration reduction effect of the engine and the vehicle upon the KEY-OFF becomes remarkably large. Accordingly, it is possible to improve the merchantability of the vehicle related to the sensibility quality.

Furthermore, it is possible to more reliably reduce simply the vibration occurrence due to the engine stop without applying additional expensive parts for vibration reduction and colliding with the torque control logic applied to the existing vehicle.

The methods and apparatuses of the present invention have other features and advantages which will be apparent from or are set forth in more detail in the accompanying drawings, which are incorporated herein, and the following Detailed Description, which together serve to explain predetermined principles of the present invention.

Figure 1:
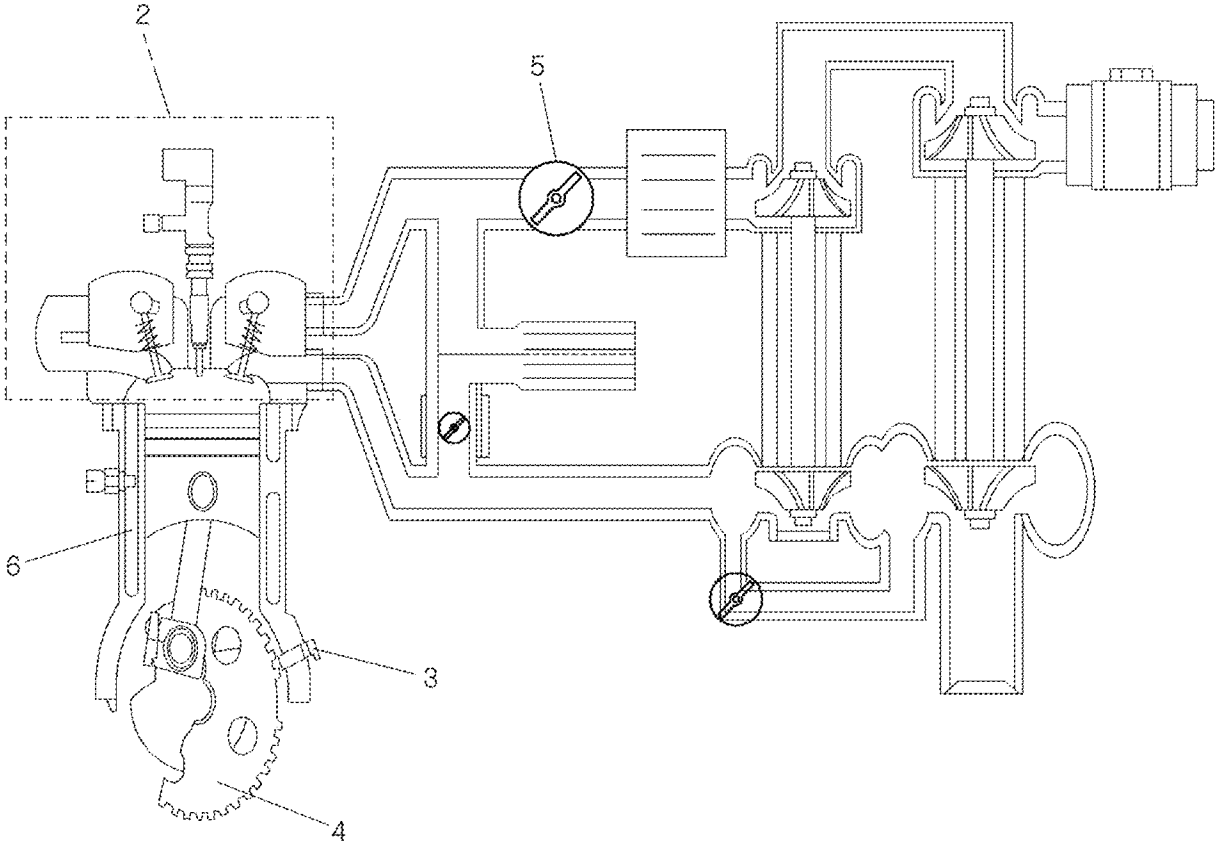
FIG. 1 is a schematic diagram of an engine having a vibration reduction device upon the KEY-OFF of the engine in accordance with an exemplary embodiment of the present invention

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments of the present invention, it will be understood that the present description is not intended to limit the invention(s) to those exemplary embodiments. On the other hand, the invention(s) is/are intended to cover not only the exemplary embodiments of the present invention, but also various alternatives, modifications, equivalents and other embodiments, which may be included within the spirit and scope of the invention as defined by the appended claims.

Hereinafter, the present invention will be described in detail with reference to the accompanying drawings.

Figure 2:
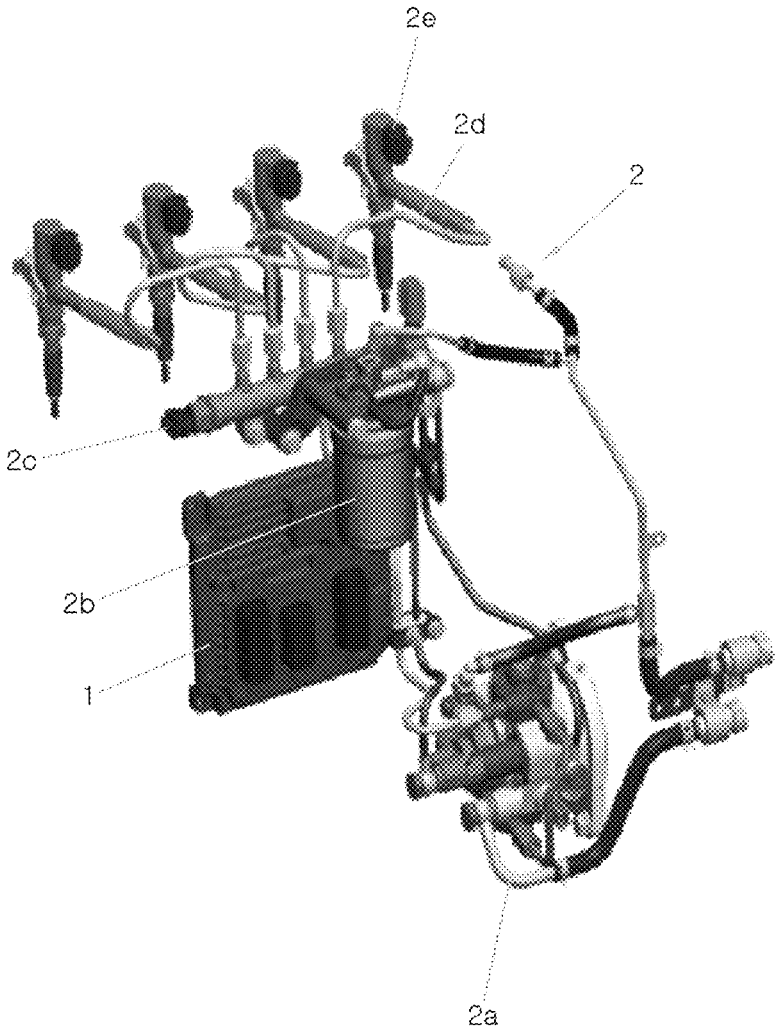
FIG. 2 is a partial enlarged diagram enlarging a portion related to a fuel injection device of the schematic diagram of the engine in FIG. 1.

FIG. 1 is a schematic diagram of an engine having a vibration reduction device upon the engine KEY-OFF in accordance with various exemplary embodiments of the present invention, and FIG. 2 is a partial enlarged diagram of a portion related to a fuel injection device of the schematic diagram of the engine in FIG. 1.

As illustrated in FIG. 1 and FIG. 2, a vibration reduction device in accordance with various exemplary embodiments of the present invention includes a fuel injection device 2 for injecting fuel stored in a fuel tank into a combustion chamber of an engine 6 depending upon a target torque value, a measurement device 3 for measuring the RPM and the rotational torque of the engine 6, and an engine control device 1 for controlling the fuel injection device 2 to finely inject fuel into the engine during a predetermined time by detecting whether or not the engine 6 becomes KEY-OFF and when it is determined to be the KEY-OFF state, setting a target torque based on the rotation torque value of the engine 6 measured upon the KEY-OFF, thus reducing the engine vibration.

The fuel injection device 2 is the device configured for injecting the fuel stored in the fuel tank not illustrated into the high-pressure, high-temperature air inside the combustion chamber of the engine 6 at a high pressure and in a spray state depending upon target torque pressure.

As illustrated in FIG. 2, the fuel injection device 2 includes a high-pressure pump 2*a* for again compressing the fuel pumped from the fuel tank by the low-pressure fuel pump not illustrated at high pressure, a fuel filter 2*b* for filtering the pumped fuel by the high-pressure pump 2*a*, a common rail 2*c* for maintaining the pressure of the high-pressure fuel filtered by the fuel filter 2*b* as it is, and distributing it through a high-pressure fuel pipe 2*d* to an individual injector 2*e*, and the injector 2*e* for injecting the fuel supplied through the high-pressure fuel pipe 2*d* into the combustion chamber of the engine 6.

The fuel injected from the fuel injection device 2 is mixed with the air supplied through a throttle valve 5 to form a mixer and burned inside the combustion chamber of the engine 6.

Meanwhile, since the torque generated in the engine 6 is determined by the fuel amount injected, a function of accurately controlling the fuel amount injected into the combustion chamber is required for obtaining a target torque. For the present purpose, the engine control device 1 controls the pressure in the common rail 2*c* by a pressure regulator, such as a pressure regulating valve not illustrated, provided in the high-pressure fuel pipe 2*d* depending upon the target torque value, and by adjusting the electric pulse time applied to the injector 2*e*, a proper fuel amount necessary for obtaining the target torque value may be injected into the cylinder of the engine 6.

The measurement device 3 detects the RPM and the rotational torque of the engine 6. The RPM of the engine 6 may be detected using a crankshaft position sensor, etc. which detects the rotational angle or the rotational position of the crankshaft of the engine 6. The rotational torque of the engine 6 may be also detected through a torque sensor disposed on a flywheel 4, etc. which is mounted on the output shaft of the crankshaft of the engine 6 to temporarily storing and releasing energy.

In the exemplary embodiment of the present invention, the engine control device 1 controls the fuel injection device 2 to finely inject the fuel into the engine during a predetermined time by detecting whether or not the engine becomes KEY-OFF and when it is determined to be the KEY-OFF state, setting the target torque based on the rotational torque value of the engine 6 measured upon the engine KEY-OFF, thus suppressing the vibration of the engine 6 that occurs upon the KEY-OFF.

The KEY-OFF of the engine 6 may be preferably determined depending upon whether or not the ignition key is switched to the OFF state by the driver. When switched into the KEY-OFF state, the engine control device 1 immediately sets the target torque to zero, or newly sets the target torque value without stopping the fuel supply, and controls the fuel injection device 2 so that the set target torque value may be achieved. More specifically, until the target torque value becomes a predetermined reference value (e.g., 0 or a value close to 0), the controls for reducing the reference target torque value at a predetermined rate and the fuel injection amount control corresponding thereto are performed. As a result, the engine 6 may be stopped more smoothly to suppress the engine vibration upon the KEY-OFF.

Herein, in the exemplary embodiment of the present invention, the reference target torque value is the rotational torque value of the engine 6 measured and stored by the measurement device 3 just before the KEY-OFF. It is possible to avoid a sudden change in the torque or the RPM of the engine 6 when performing the vibration reduction control using the rotational torque value of the engine 6 just before the KEY-OFF as a reference.

And, the engine control device 1 reduces the rotational torque value of the engine 6 measured and stored just before the KEY-OFF depending upon the RPM of the engine 6 or the elapsed time after the KEY-OFF.

Figure 7A:
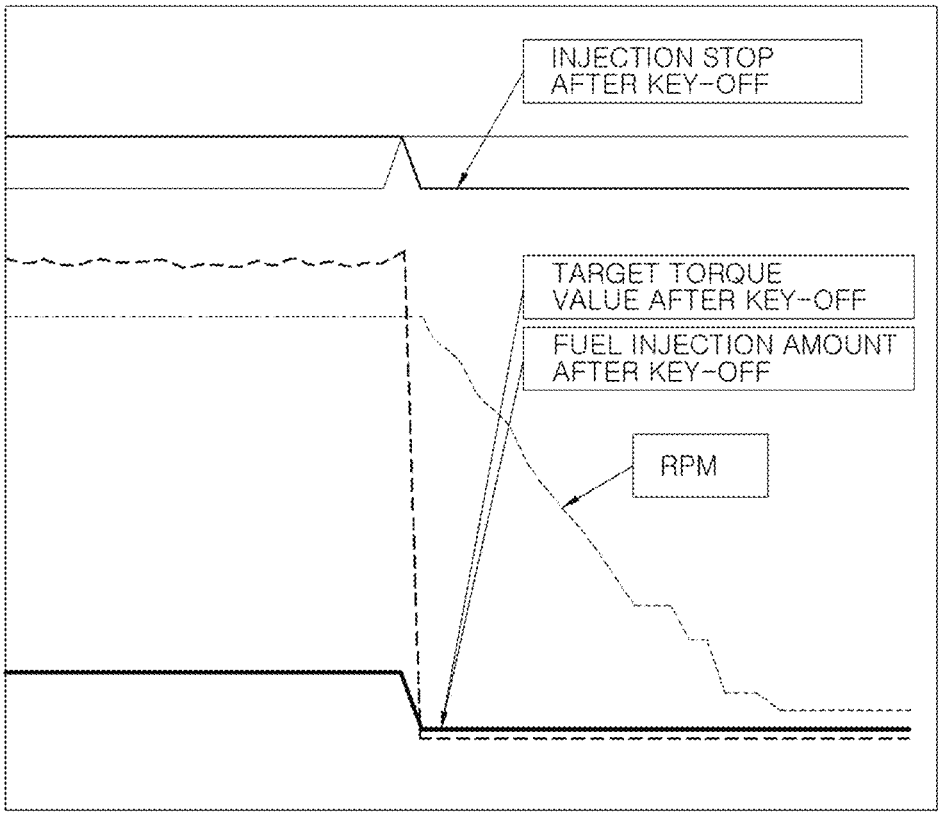
FIG. 7A is a graph illustrating the change depending upon the time of the target torque value, the fuel injection amount, and the RPM of the engine upon the KEY-OFF of the conventional engine.
Figure 7B:
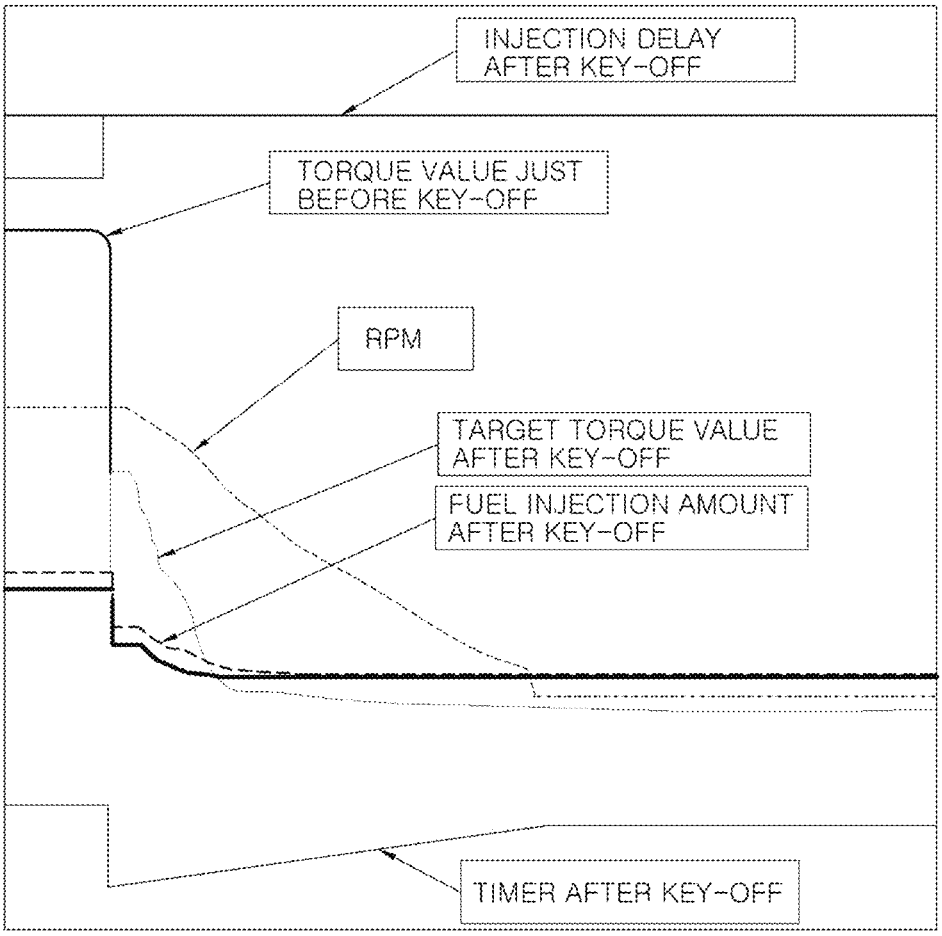
FIG. 7B is a graph illustrating the change depending upon the time of the target torque value, the fuel injection amount, and the RPM of the engine upon the KEY-OFF of the engine when performing the vibration reduction control based on the timer of the present invention.
Figure 7C:
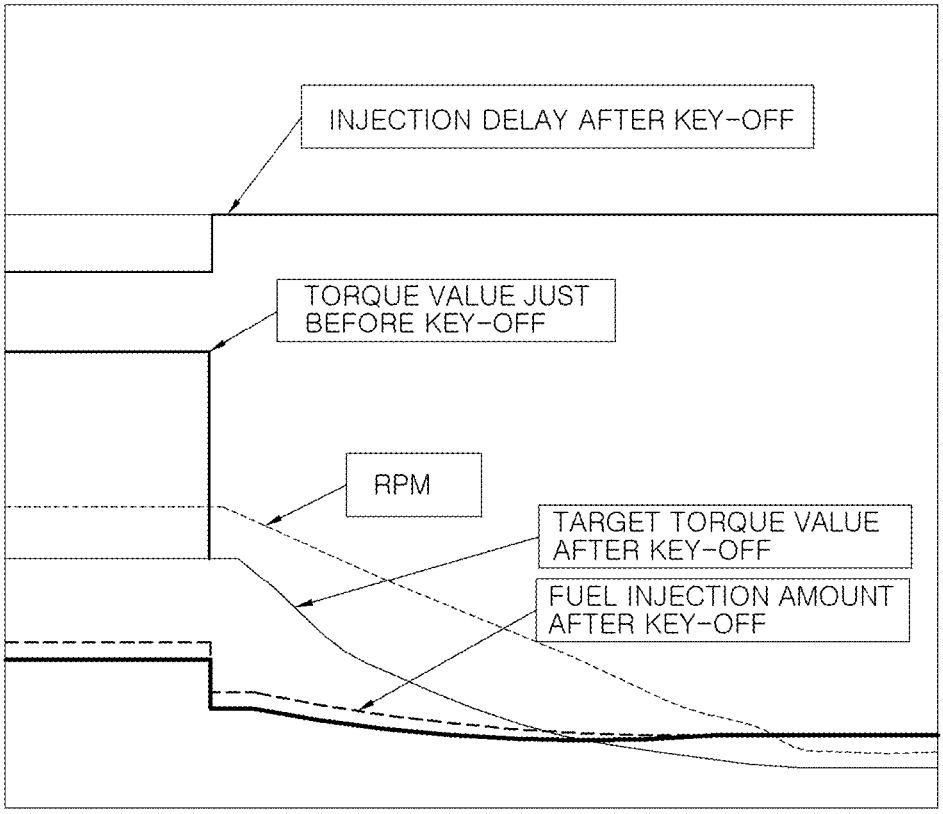
FIG. 7C is a graph illustrating the change depending upon the time of the target torque value, the fuel injection amount, and the RPM of the engine upon the KEY-OFF of the engine when performing the vibration reduction control based on the RPM of the engine of the present invention.

For example, as illustrated in Table 1 below, it is assumed that the target torque value (the rotational torque value of the engine 6 just before the KEY-OFF) is determined as a reference at a predetermined rate depending upon the RPM of the engine. Assuming that the torque value of the engine 6 just before the KEY-OFF is 100 kgfm and in the present time, the idle RPM of the engine 6 is 600 RPM, the target torque value becomes 50 kgfm. When the fuel injection device 2 is controlled so that the corresponding target torque value is achieved, the RPM of the engine 6 is reduced. When the RPM of the engine 6 is reduced to 300 RPM, the target torque value becomes 20 kgfm. As described above, when performing the fine injection control of the fuel while reducing the rotational torque value of the engine 6 just before the KEY-OFF at a predetermined rate depending upon the RPM of the engine 6, as illustrated in FIG. 7C, the RPM of the engine 6 is gradually reduced to suppress the vibration of the engine 6 upon the KEY-OFF.

TABLE 1

| | RPM | | | | | | | | | |
|---|---|---|---|---|---|---|---|---|---|---|
| | 0 | 50 | 100 | 150 | 200 | 250 | 300 | 400 | 500 | 600 |
| % | 0 | 0 | 2 | 3 | 5 | 10 | 20 | 30 | 40 | 50 |

In the exemplary embodiment of the present invention, not only the RPM of the engine 6 but also the elapsed time after the KEY-OFF are counted, and a control of reducing the target torque value (the rotational torque value of the engine 6 just before the KEY-OFF) at a predetermined rate may be also performed. For example, as illustrated in Table 2 below, it is assumed that the target torque value (the rotational torque value of the engine 6 just before the KEY-OFF) is determined as a reference at a predetermined rate depending upon the elapsed time. The torque value of the engine 6 just before the KEY-OFF is 100 kgfm, and the target torque value becomes 30 kgfm after 200 ms from upon the KEY-OFF. Furthermore, after 600 ms from upon the KEY-OFF, the target torque value becomes 10 kgfm. As described above, when performing the fine injection control of the fuel while reducing the target torque value as a reference at a predetermined rate depending upon the elapsed time from upon the KEY-OFF, as illustrated in FIG. 7B, the RPM of the engine 6 may be smoothly reduced to suppress the vibration of the engine 6 upon the KEY-OFF.

TABLE 2

| | RPM | | | | | | | | | |
|---|---|---|---|---|---|---|---|---|---|---|
| | 0 | 200 | 400 | 600 | 800 | 1000 | 1200 | 1400 | 1600 | 1800 |
| % | 50 | 30 | 15 | 10 | 8 | 5 | 3 | 0 | 0 | 0 |

Meanwhile, when the target torque value is determined by the predetermined table, the change in the torque value has the shape of a step function for each specific section, which may be somewhat disadvantageous to the vibration reduction control. Accordingly, it is preferable to control so that the target torque value changes more smoothly by interpolating the set target torque value by a predetermined interpolation method, and performing the fine injection control of the fuel based on the interpolated target torque value.

Among the above two embodiments, it is preferable to reduce the rotational torque value of the engine 6 as a reference depending upon the RPM of the engine 6 at a predetermined rate for performing a relatively accurate control. However, when the RPM of the engine 6 is lower than a predetermined level, an excessive time may be passed for the vibration reduction control, and it may be more preferable to control it depending upon the elapsed time. Accordingly, in the exemplary embodiment of the present invention, the engine control device 1 measures the RPM of the engine 6 upon the KEY-OFF; and when the measured RPM of the engine 6 exceeds a predetermined reference value, the control of reducing the rotational torque value as a reference depending upon the RPM of the engine 6 may be performed, and when the measured RPM of the engine 6 is equal to or smaller than the predetermined reference value, the control of reducing the rotational torque value of the engine 6 as a reference at a predetermined rate depending upon the elapsed time from upon the KEY-OFF may be performed.

In the above-described example, the exemplary embodiment that reduces the rotational torque value of the engine 6 as a reference at a predetermined rate depending upon the RPM of the engine 6 or the elapsed time from upon the KEY-OFF, but the present invention is not limited thereto, and the two control methods may be used in combination. Preferably, firstly, the control of reducing the rotational torque value of the engine 6 as a reference at a predetermined rate depending upon the RPM of the engine 6 is performed, and as a result of performing the control, when the RPM of the engine 6 is equal to or smaller than a predetermined reference value, the control of reducing the rotational torque value of the engine 6 as a reference at a predetermined rate depending upon the elapsed time from upon the KEY-OFF may be also performed.

Meanwhile, the engine control device 1 can first determine whether or not the condition for performing the vibration reduction control upon the KEY-OFF are satisfied, and determine whether or not to perform the vibration reduction control depending upon the determination result. For example, when it is possible to set in advance whether or not to delay the fuel injection ending timing to the timing after the KEY-OFF, the engine control device 1 confirms the setting value in advance before performing the vibration reduction control, and only when it is set to delay the fuel injection ending timing up to the timing after the KEY-OFF, the vibration reduction control may be performed. When it is preset to be unable to delay the fuel injection ending timing, the engine control device 1 sets the target torque value to zero and sets the fuel injection amount to zero to stop the engine like upon a general engine stop.

Meanwhile, when it is not preferable to perform the vibration reduction control, the engine control device 1 can decide not to perform the vibration reduction control. For example, when the vibration reduction control is performed upon the failure of the fuel injection device 2 such as the injector 2*e* or the measurement device 3, the actual RPM of the engine 6 does not become low even if the target torque is low, and thereby a phenomenon in which the KEY-OFF does not become can occur. Accordingly, in the instant case, it is preferable to stop the engine by setting the target torque value to zero and the fuel injection amount to zero without performing the vibration reduction control. In a commercial vehicle, it is preferable to stop the engine by setting the target torque value to zero and the fuel injection amount to zero considering the safety of the operation, etc. like upon the existing KEY-OFF even when the power take-off device connected to the transmission, etc. is in operation upon the KEY-OFF.

Figure 3:
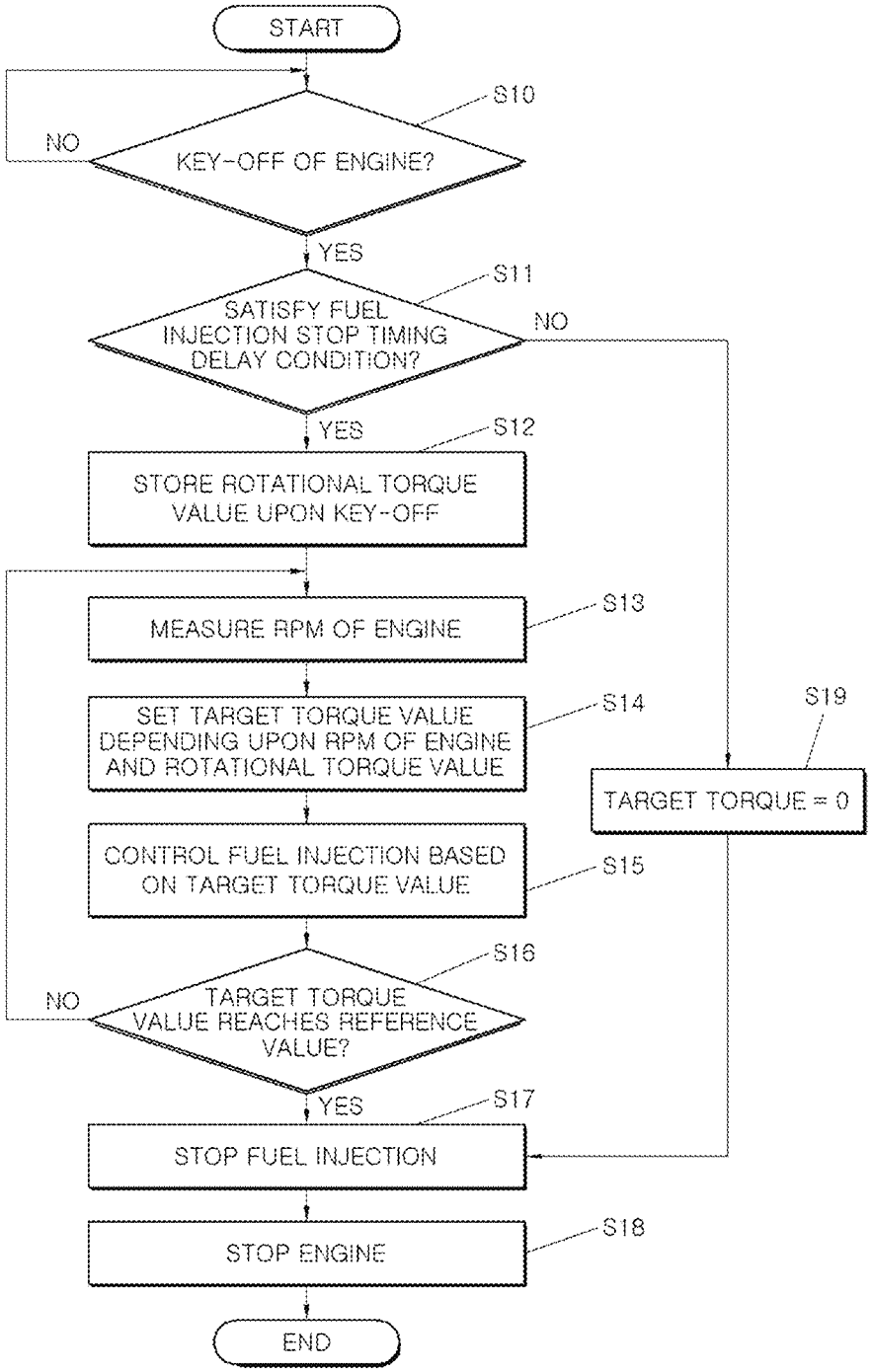
FIG. 3 is a flowchart illustrating a vibration reduction method upon the KEY-OFF of the engine in accordance with an exemplary embodiment of the present invention.

FIG. 3 is a flowchart illustrating the vibration reduction method based on the RPM of the engine 6 in accordance with the exemplary embodiment of the present invention.

As illustrated in FIG. 3, the engine control device 1 first determines whether or not the KEY-OFF of the engine 6 is performed S10 by the ignition key operation of the driver, etc. When it is determined that the KEY-OFF operation of the engine 6 has been performed, the engine control device 1 determines whether or not the fuel injection ending timing satisfies the condition which may be delayed until after the KEY-OFF of the engine 6 as the requirement for performing the vibration reduction control S11. The engine control device 1 determines whether or not a setting value is set to delay the fuel injection ending timing, or whether or not it is determined that a failure has occurred in the fuel injection device 2 or the measurement device 3, and whether or not the power take-off device is in use upon the KEY-OFF. The working vehicle such as a dump truck, a high-altitude driving car, a sweeping car, and a ladder car is provided with a working device including a hydraulic device, etc. To appropriately perform the operation to be performed in addition to driving the road. The working device disposed in the working vehicle is driven and operated by the power drawn from a portion of the power generated from the engine of the vehicle, and the device configured for branching out a portion of the main power produced from the engine of the vehicle is called a power take-off device. The engine control device 1 determines whether or not the power take-off device used in such a working vehicle is in use.

When it is determined that the setting value is set to delay the fuel injection ending timing and that there is no failure in the fuel injection device 2 or the measurement device 3 while it is determined that the power take-off device is not used upon the KEY-OFF, the engine control device 1 determines that the fuel injection ending timing can satisfy the condition which may be delayed until after the KEY-OFF of the engine 6 to start the following vibration reduction control. When it is determined that the fuel injection ending timing does not satisfy the condition which may be delayed until after the KEY-OFF of the engine 6, the engine control device 1 does not perform the vibration reduction control, and sets the target torque to zero S19 and controls the fuel injection device 2 to stop the fuel injection stop S17, thus finally stopping the engine 6 S18.

For the present purpose, the engine control device 1 stores as the reference rotational torque value the rotational torque value of the engine 6 upon the KEY-OFF measured by the measurement device 3 S12. And, the RPM of the engine 6 at the instant time is measured using the measurement device 3 S13. And, the engine control device 1 sets as a target torque value a value obtained by reducing the rotational torque value stored in the S12 at a predetermined rate depending upon the RPM of the engine 6 measured in the S13 S14. The reduction rate is a predetermined value for each specific RPM of the engine 6, and may be determined by a table in which the reduction rate increases as the RPM decreases. The target torque value depending upon the RPM of the engine 6 is interpolated by a predetermined interpolation method during the RPM of the engine 6 between the specific RPMs, and the change in the target torque value is smoothly performed.

When the target torque value is determined, the engine control device 1 adjusts the electric pulse time applied upon control of the injector 2*e* of the fuel injection device 2 or regulates the fuel pressure in the common rail 2*c*, such that the fuel corresponded to the target torque value is finely injected S15.

The engine control device 1 repeats the controls of the S13 to S15 until the target torque value reaches a predetermined reference value. As the control is repeated, the RPM of the engine 6 is reduced, as illustrated in FIG. 7C, and thereby, the set target torque value is also reduced. When the target torque value reaches a predetermined reference value (e.g., 0 or a predetermined value close to 0) S16, the engine control device 1 controls the fuel injection device 2 to stop the fuel injection S17, thus finally stop the engine 6 S18.

Figure 4:
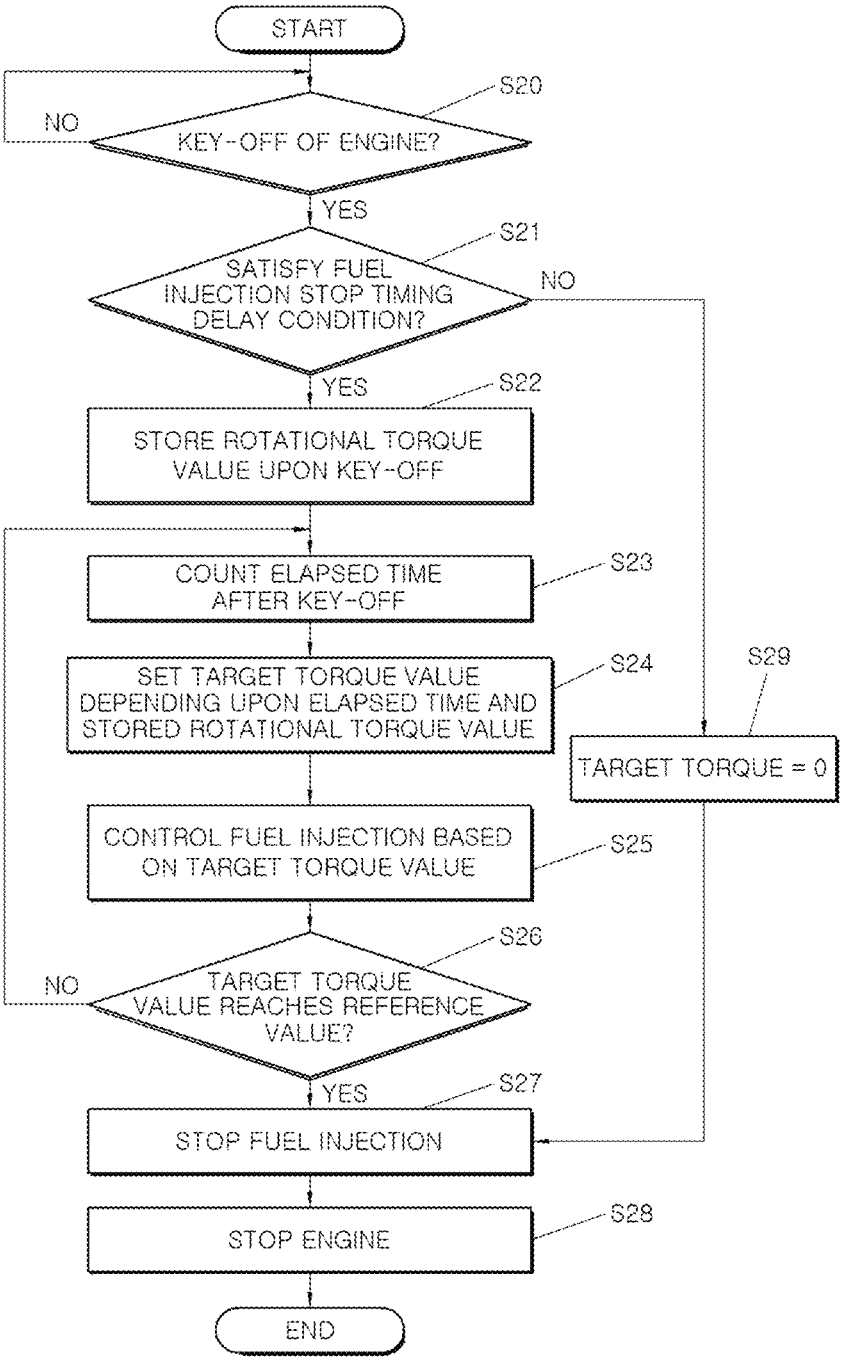
FIG. 4 is a flowchart illustrating the vibration reduction method upon the KEY-OFF of the engine in accordance with various exemplary embodiments of the present invention.

FIG. 4 is a flowchart illustrating a timer based vibration reduction method in accordance with the exemplary embodiment of the present invention. A detailed description of the steps substantially the same as those illustrated in FIG. 3 will be omitted.

Unlike the S13 in FIG. 3, which measures the RPM of the engine 6 when it is determined that the fuel injection ending timing satisfies the condition which may be delayed until after the KEY-OFF of the engine 6, in S23 in FIG. 4, the time elapsed after the KEY-OFF is counted. And, the engine control device 1 sets as a target torque value a value obtained by reducing the rotational torque value stored in the S12 at a predetermined rate depending upon the elapsed time after the KEY-OFF, which is measured in the S23 S24. The reduction rate is a predetermined value for each specific elapsed time of the engine 6, and may be determined by a table in which the reduction rate increases as the elapsed time increases. Furthermore, the target torque value is interpolated by a predetermined interpolation method in the section between the specific elapsed times, such that the change in the target torque value may be smoothly performed.

When the target torque value is determined, the engine control device 1 adjusts the electric pulse time applied upon control of the injector 2*e* of the fuel injection device 2 or regulates the fuel pressure in the common rail 2*c*, such that the fuel corresponded to the target torque value is finely injected S25.

The engine control device 1 repeats the controls of the S23 to S25 until the target torque value reaches a predetermined reference value. As the control is repeated, the elapsed time increases, as illustrated in FIG. 7B, and thereby, the set target torque value is also reduced. When the target torque value reaches a predetermined reference value (e.g., 0 or a predetermined value close to 0) S26, as in the exemplary embodiment illustrated in FIG. 3, the engine control device 1 controls the fuel injection device 2 to stop the fuel injection S27, thus finally stopping the engine 6 S28.

Figure 5A:
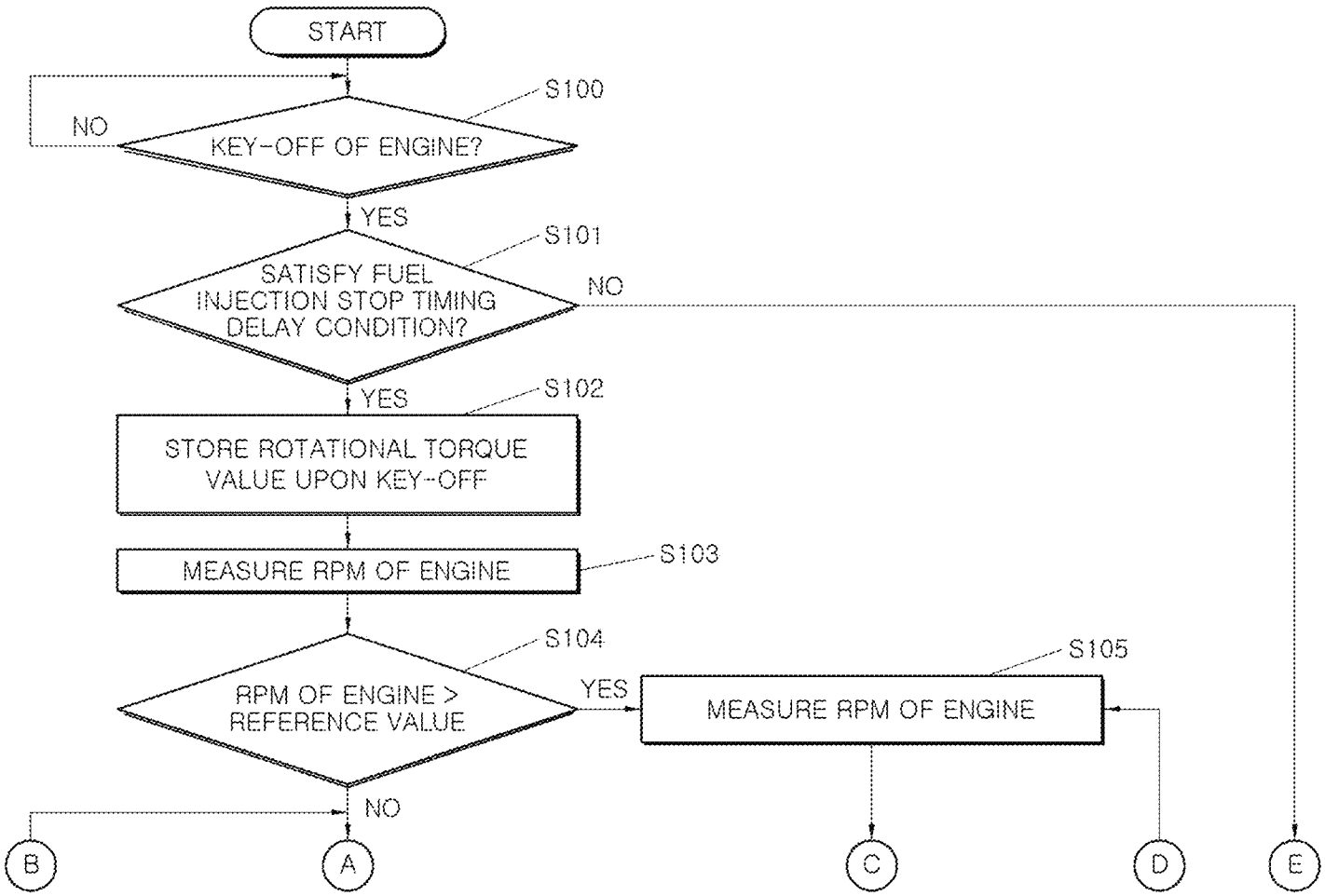
FIG. 5A and FIG. 5B are flowcharts illustrating the vibration reduction method upon the KEY-OFF of the engine in accordance with various exemplary embodiments of the present invention.
Figure 5B:
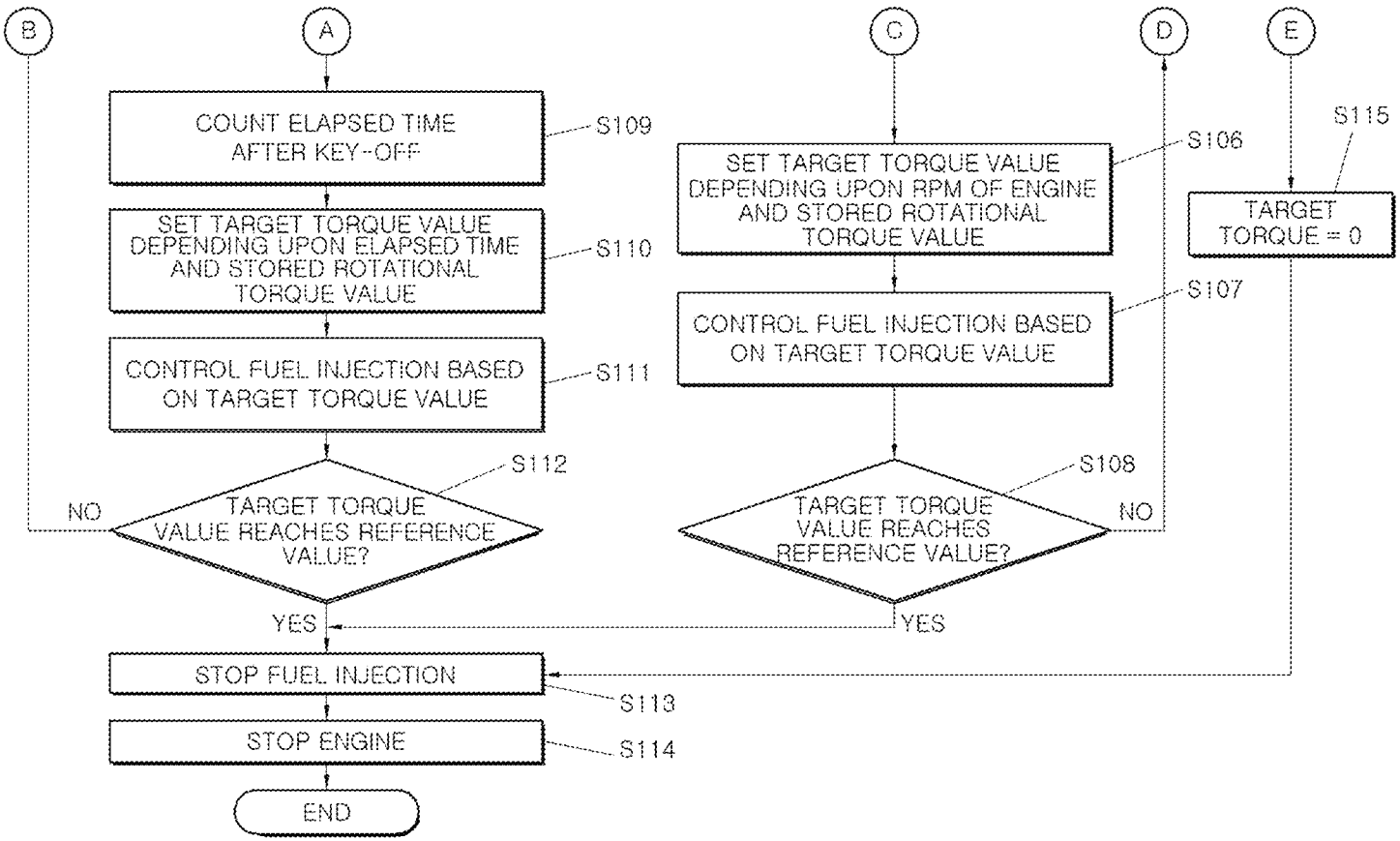

FIG. 5A and FIG. 5B illustrating a vibration reduction method upon the KEY-OFF of the engine in accordance with various exemplary embodiments of the present invention. A detailed description of the steps substantially the same as those illustrated in FIG. 3 and FIG. 4 will be omitted. Unlike the exemplary embodiment illustrated in FIG. 3 and FIG. 4, in the exemplary embodiment illustrated in FIGS. 5A and 5B, it is determined that the vibration reduction control is performed by which method of the vibration reduction controls illustrated in FIG. 3 and FIG. 4 depending upon the RPM of the engine 6 measured upon the KEY-OFF.

Specifically, the engine control device 1 determines that the fuel injection ending timing satisfies the condition which may be delayed until after the KEY-OFF of the engine 6 S101, and when the vibration reduction control is started, the RPM of the engine 6 is first measured using the measurement device 3 S103. As such, the measured RPM of the engine 6 is compared with a predetermined reference value S104.

When the RPM of the engine 6 exceeds a predetermined reference value as a comparison result in the S104, it is determined that the vibration reduction control based on the RPM of the engine 6 is more accurate and faster to perform the control in S105 to S107. The control in the S105 to S107 corresponds to the measuring the RPM of the engine 6 in the S12, the setting the target torque value in the S14, and the setting the fine injection control of the fuel based on the target torque value in the S15 in FIG. 3.

Meanwhile, when it is determined that the RPM of the engine 6 is equal to or smaller than a predetermined reference value as a comparison result in the S104, it is determined that the vibration reduction control based on the timer is faster to perform the control in S109 to S111. The control in the S109 to S111 corresponds to the counting the elapsed time after the KEY-OFF in the S23, the setting the target torque value in the S24, and the controlling the fine injection of fuel based on the target torque value in the S25 in FIG. 4.

When the engine control device 1 compares the target torque value when performing the vibration reduction control based on the timer or the vibration reduction control based on the RPM of the engine 6 with a predetermined reference value S107, S101 and it is determined to be reached, the engine control device 1 controls the fuel injection device 2 to stop the fuel injection S27, thus finally stopping the engine 6 S28.

In the exemplary embodiment illustrated in FIGS. 5A and 5B, the RPM of the engine 6 upon the KEY-OFF is measured, and by determining which method vibration reduction control is performed based on the measured value, a more suitable vibration reduction control may be selected and implemented depending upon traveling situation.

Figure 6A:
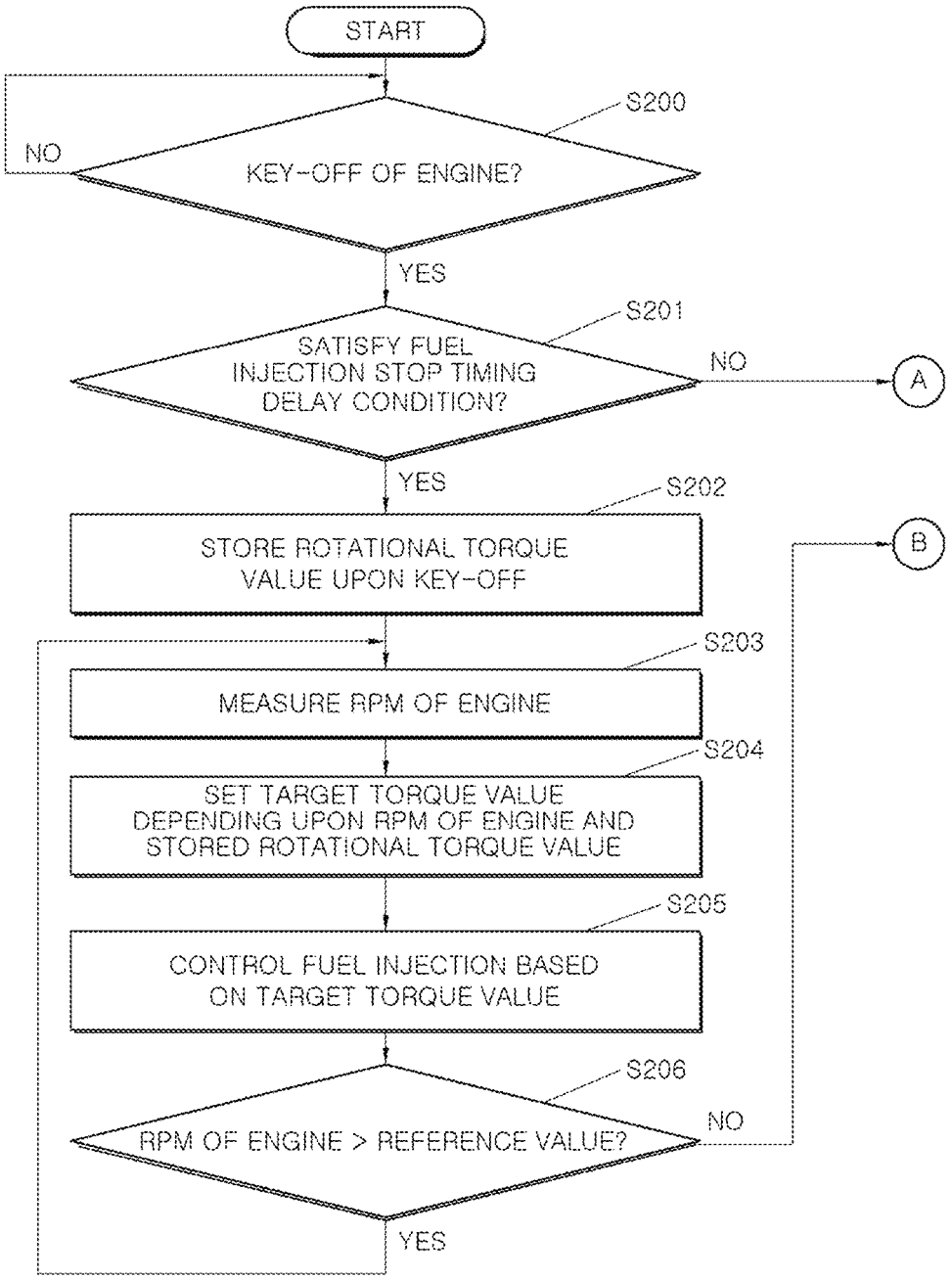
FIG. 6A and FIG. 6B are flowcharts illustrating the vibration reduction method upon the KEY-OFF of the engine in accordance with various exemplary embodiments of the present invention.
Figure 6B:
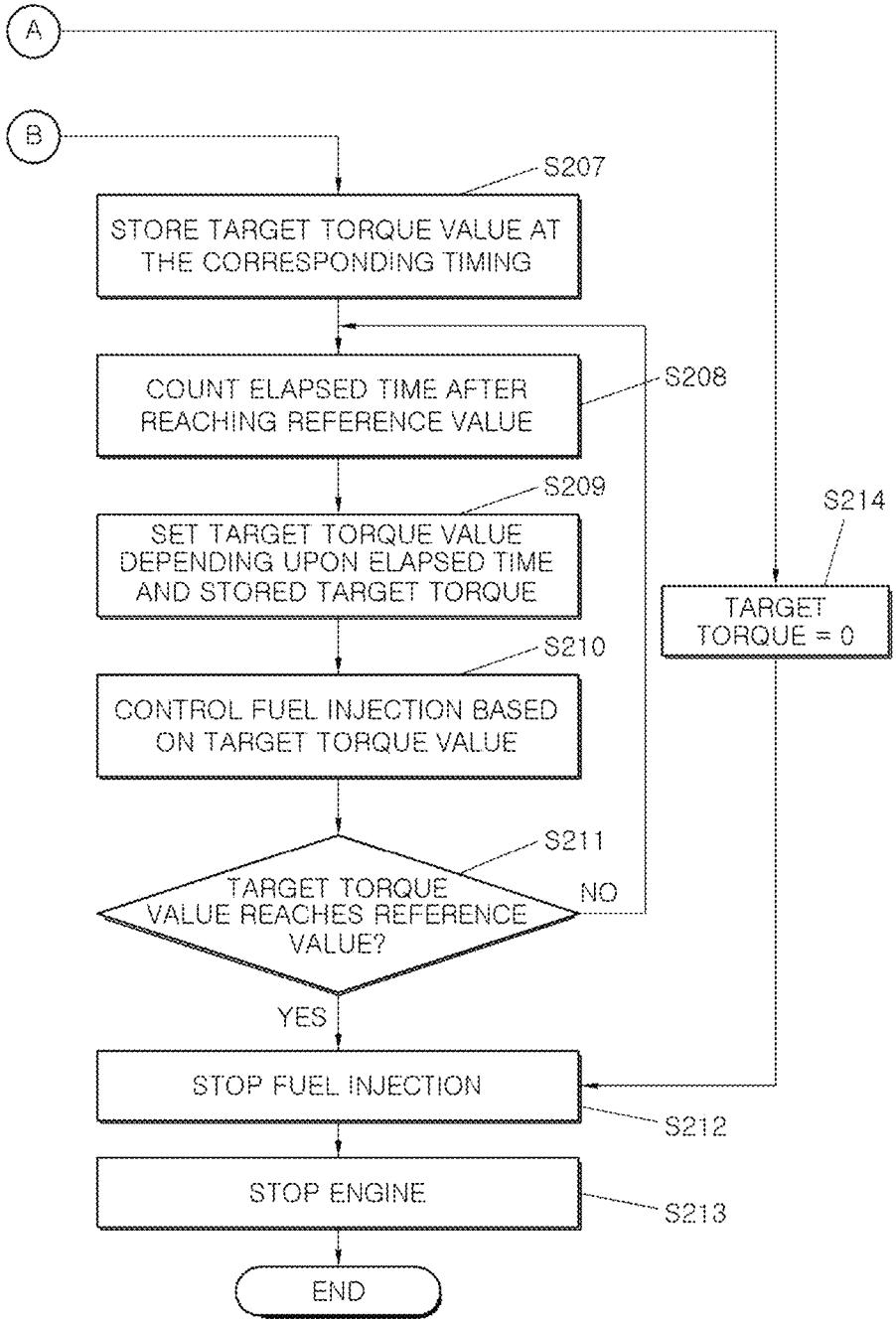

FIG. 6A and FIG. 6B are flowcharts illustrating the vibration reduction method upon the KEY-OFF of the engine in accordance with various exemplary embodiments of the present invention. A detailed description of the steps substantially the same as those illustrated in FIG. 3, FIG. 4, and FIG. 5 will be omitted. Unlike the exemplary embodiment illustrated in FIG. 3, FIG. 4, and FIG. 5, in the exemplary embodiment illustrated in FIG. 6A and FIG. 6B, the vibration reduction control based on the RPM of the engine 6 illustrated in FIG. 3 and the vibration reduction control based on the timer illustrated in FIG. 4 are performed in combination.

For the present purpose, the engine control device 1 determines that the fuel injection ending timing satisfies the condition which may be delayed until after the KEY-OFF of the engine 6 S201, and when the vibration reduction control is started, the vibration reduction control based on the RPM of the engine 6 is first performed. Since the RPM of the engine 6 is relatively high at the beginning of the KEY-OFF, the vibration reduction control based on the RPM of the engine 6 may be performed with more accurate vibration reduction control.

Accordingly, after storing the rotational torque value of the engine 6 upon the KEY-OFF S202, the engine control device 1 performs the vibration reduction control based on the RPM of the engine 6 in S203 to S205. The control in the S203 to S205 corresponds to the measuring the RPM of the engine 6 in the S12, the setting the target torque value in the S14, and the controlling the fine injection of the fuel based on the target torque value in the S15 in FIG. 3.

When the RPM of the engine 6 is reduced as a result of the fine injection control of the fuel, the engine control device 1 determines whether or not the RPM of the engine 6 measured by the measurement device 3 is equal to or smaller than a predetermined reference value S206. When the RPM of the engine 6 is equal to or smaller than a predetermined level, the vibration reduction control based on the timer may be performed more rapidly and accurately than the vibration reduction control based on the RPM of the engine 6. Accordingly, when it is determined that the RPM of the engine 6 is equal to or smaller than a predetermined reference value, the engine control device 1 performs the vibration reduction control based on the timer in S207 to S210. When it is determined that the RPM of the engine 6 has exceeded a predetermined reference value, the engine control device 1 repeats the S203 to S205 until the RPM of the engine 6 becomes the reference value or less.

For the present purpose, the engine control device 1 stores the target torque value at the corresponding timing S207. This is for setting the final target torque value upon vibration control based on the RPM of the engine 6 before performing the vibration reduction control based on the timer as a reference torque value upon the vibration reduction control based on the timer.

Next, the engine control device 1 counts the elapsed time from the timing of starting the vibration reduction control based on the timer, that is, the timing at which the RPM of the engine 6 reaches the reference value S208.

Then, the engine control device 1 sets as a target torque value a value obtained by reducing the rotational torque value stored in the S207 at a predetermined ratio depending upon the elapsed time, which is measured in the S208, from the timing at which the RPM of the engine 6 reaches the reference value S209. The reduction rate is a predetermined value for each specific elapsed time of the engine 6, and may be determined by a table in which the reduction rate increases as the elapsed time increases. Furthermore, the target torque value is interpolated by a predetermined interpolation method in the section between the specific elapsed times, such that the change in the target torque value may be smoothly performed.

The engine control device 1 repeats the control of the S208 to S210 until the target torque value reaches a predetermined reference value. As the control is repeated, the elapsed time increases, and thereby, the target torque value to be set is also reduced. When the target torque value reaches a predetermined reference value (e.g., 0 or a predetermined value close to 0) S211, as in the exemplary embodiment illustrated in FIG. 4, the engine control device 1 controls the fuel injection device 2 to stop the fuel injection S212, thus finally stopping the engine 6 S213.

According to the exemplary embodiment illustrated in FIG. 6A and FIG. 6B, the vibration reduction control based on the RPM of the engine 6 is performed at the initial KEY-OFF when the RPM of the engine 6 is high, and when the RPM is equal to or smaller than the reference value, by switching into the vibration reduction control based on the timer, it is possible to rapidly and accurately control the vibration throughout the entire vibration control section.

Figure 8A:
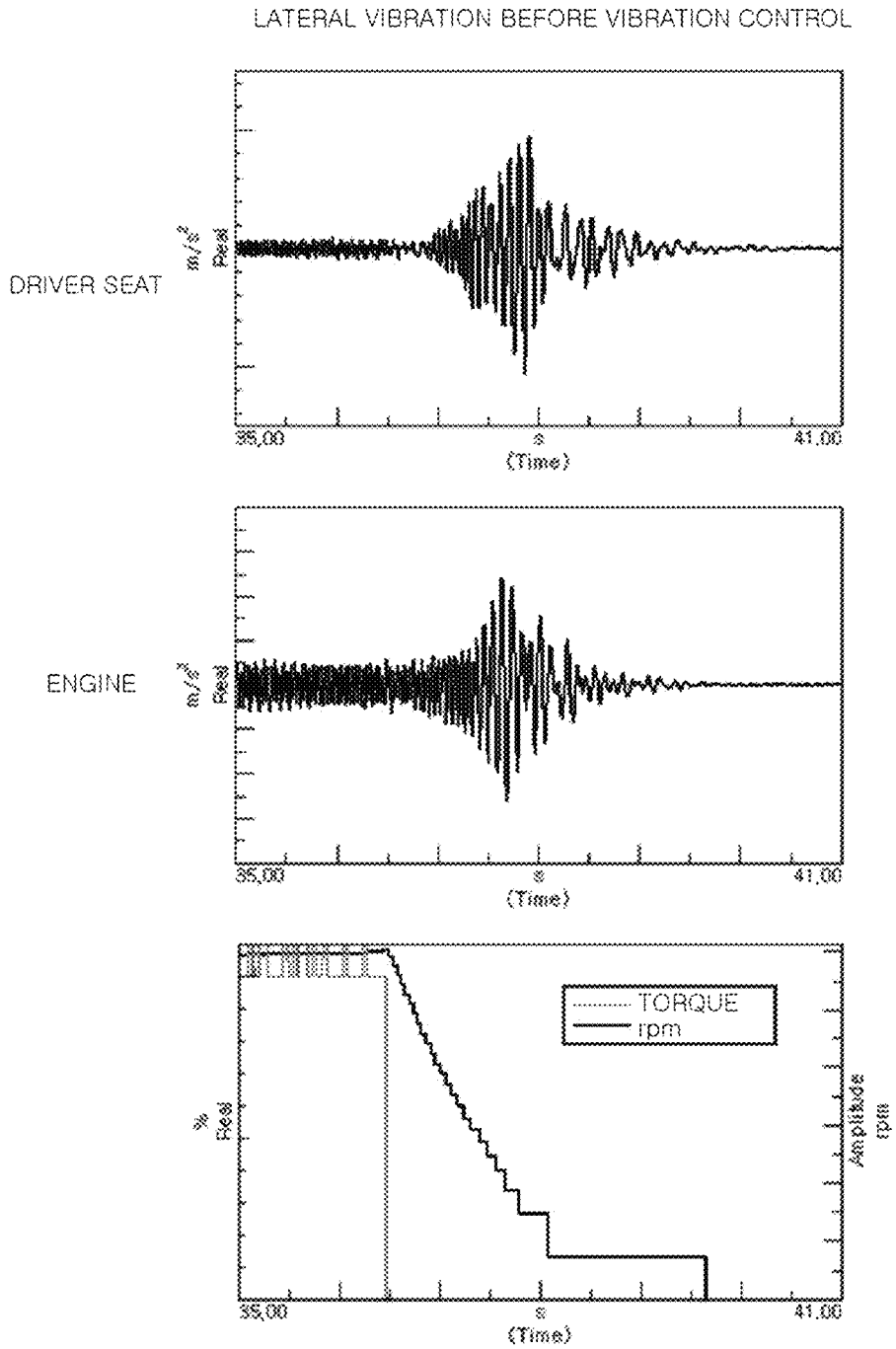
FIG. 8A is a graph illustrating the amount of lateral vibration in the driver seat and the engine of the vehicle upon the KEY-OFF of the engine before the vibration reduction control.
Figure 8B:
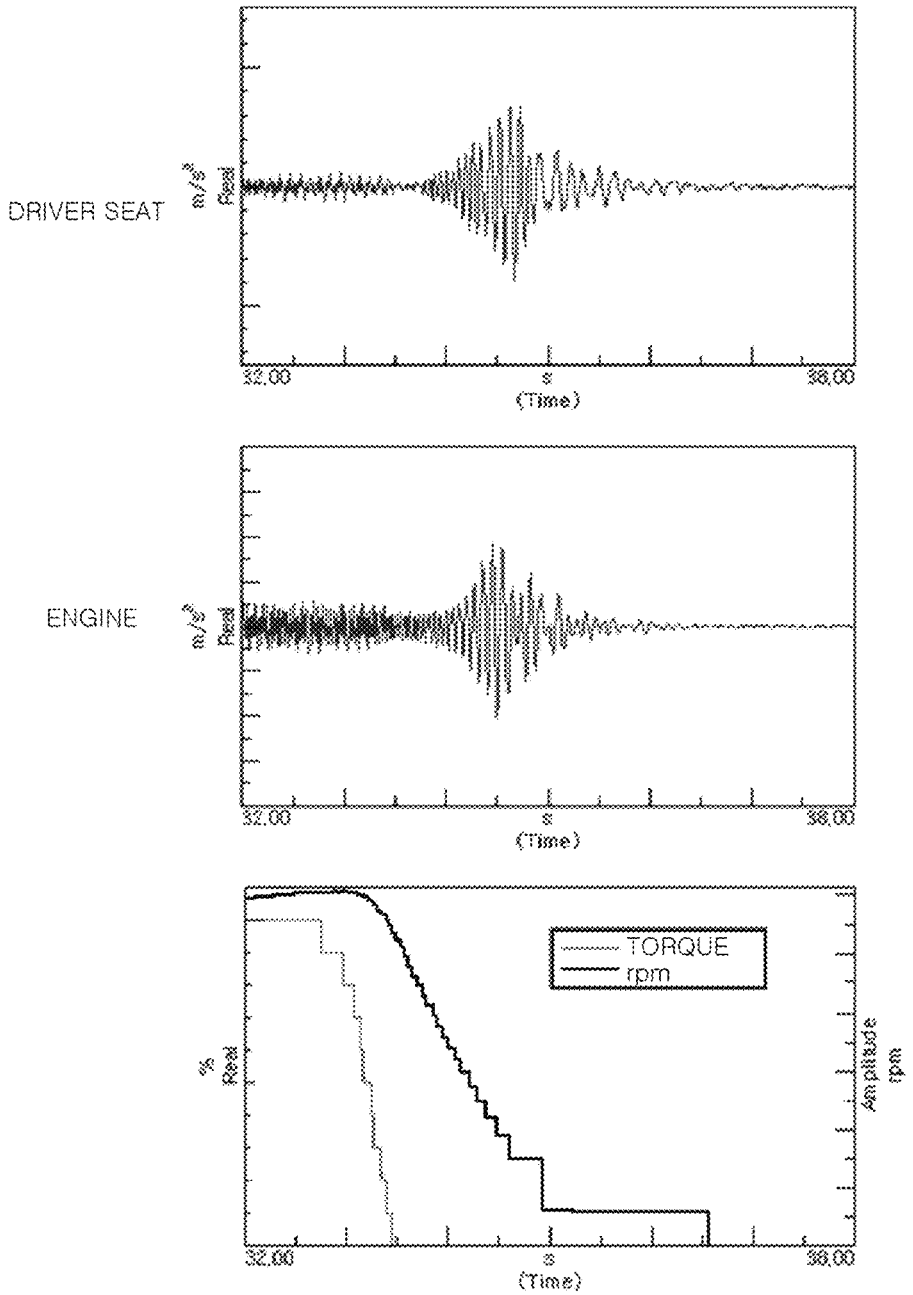
FIG. 8B is a graph illustrating the amount of lateral vibration in the driver seat and the engine of the vehicle upon the KEY-OFF of the engine when performing the vibration reduction control based on the timer for 500 ms time.
Figure 8C:
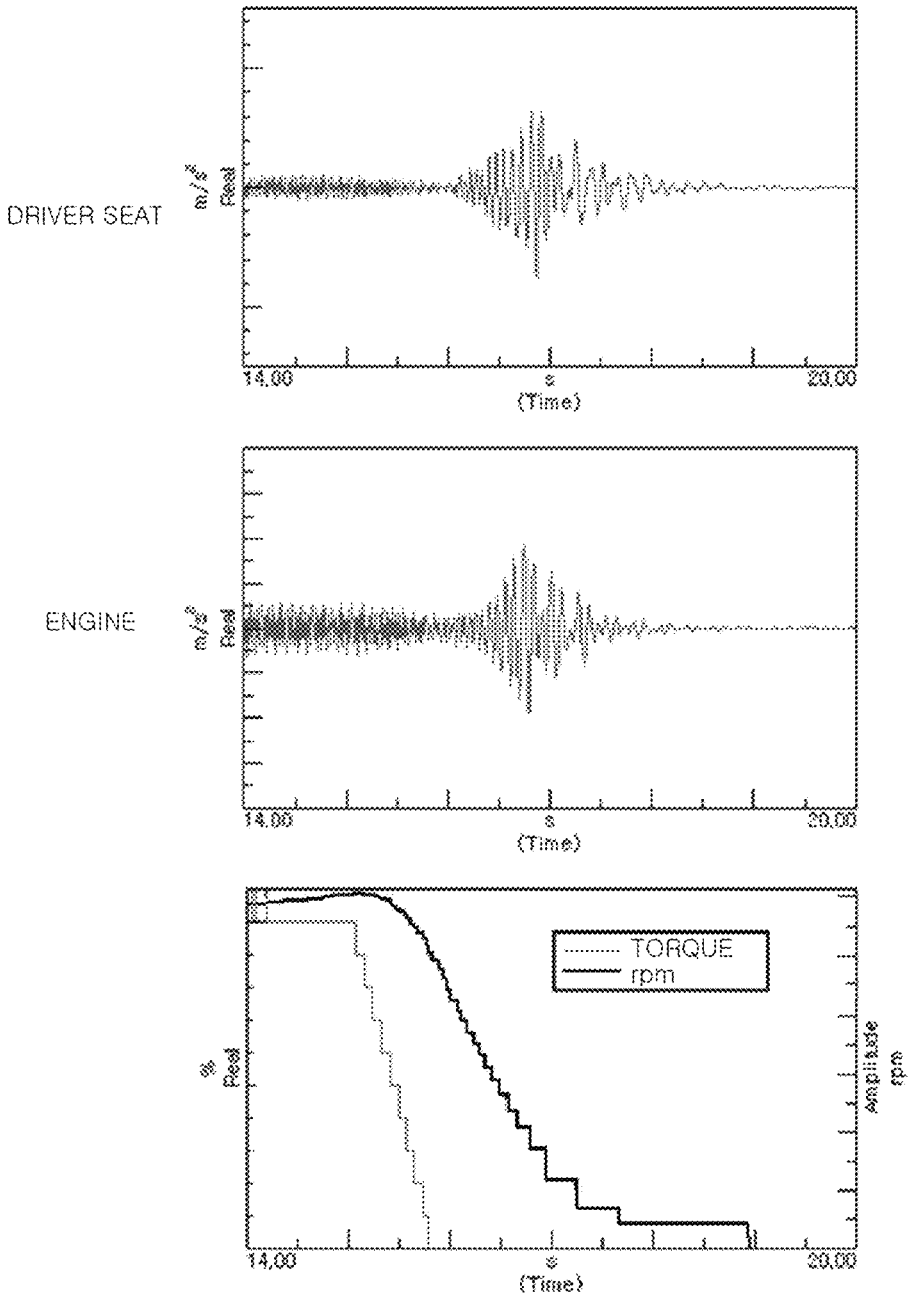
FIG. 8C is a graph illustrating the amount of lateral vibration in the driver seat and the engine of the vehicle upon the KEY-OFF of the engine when performing the vibration reduction control based on the timer for 800 ms time.
Figure 8D:
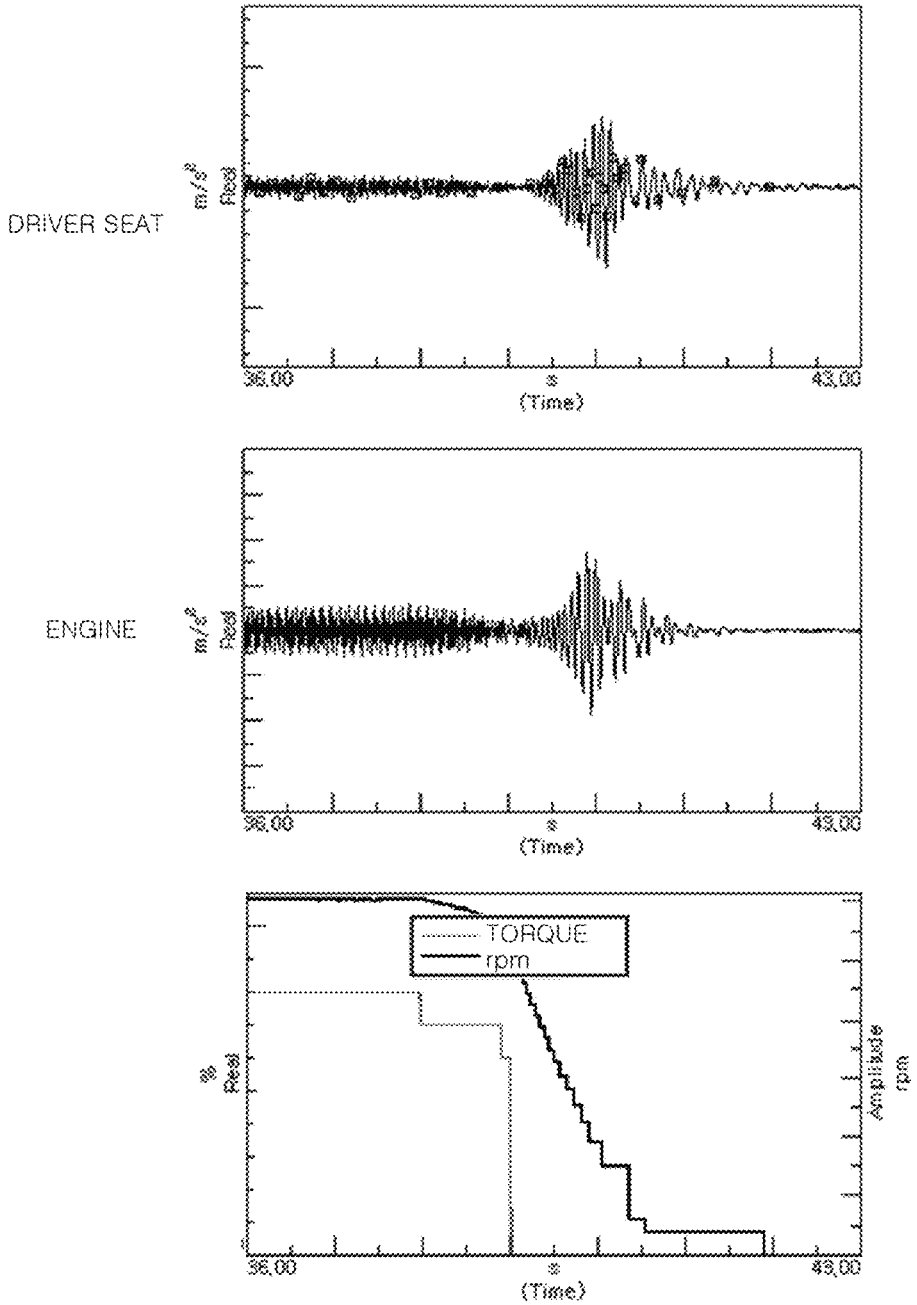
FIG. 8D is a graph illustrating the amount of lateral vibration in the driver seat and the engine of the vehicle upon the KEY-OFF of the engine when performing the vibration reduction control based on the RPM of the engine.

FIG. 8A is a graph illustrating the amount of lateral vibration in the driver seat and the engine of the vehicle upon the KEY-OFF of the engine before the vibration reduction control, and FIG. 8B is a graph illustrating the amount of lateral vibration in the driver seat and the seat of the vehicle when performing the vibration reduction control based on the timer for 500 ms time under the same condition. Furthermore, FIG. 8C is a graph illustrating the amount of lateral vibration in the driver seat and the engine of the vehicle upon the KEY-OFF of the engine when performing the vibration reduction control based on the timer for 800 ms time under the same condition, and FIG. 8D is a graph illustrating the amount of lateral vibration in the driver seat and the engine of the vehicle upon the KEY-OFF of the engine when performing the vibration reduction control based on the RPM of the engine under the same condition.

As illustrated in FIG. 8A, FIG. 8B, FIG. 8C, and FIG. 8D, by employing the vibration control method in accordance with various aspects of the present invention, the amount of lateral vibration generated in the engine and the vehicle body upon the KEY-OFF of the vehicle may be greatly reduced.

Figure 9A:
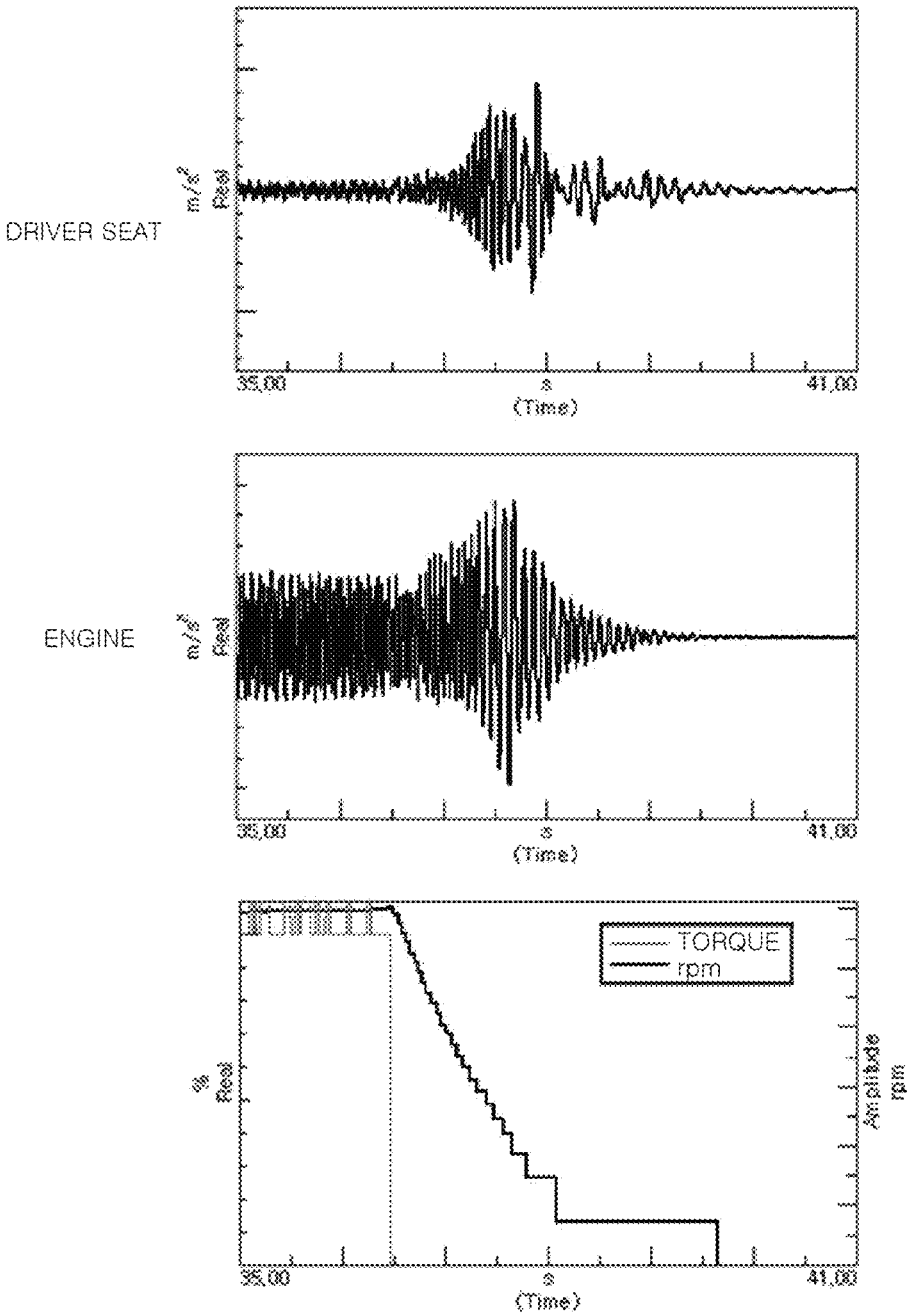
FIG. 9A is a graph illustrating the amount of vertical vibration in the driver seat and the engine of the vehicle upon the KEY-OFF of the engine before the vibration reduction control.
Figure 9B:
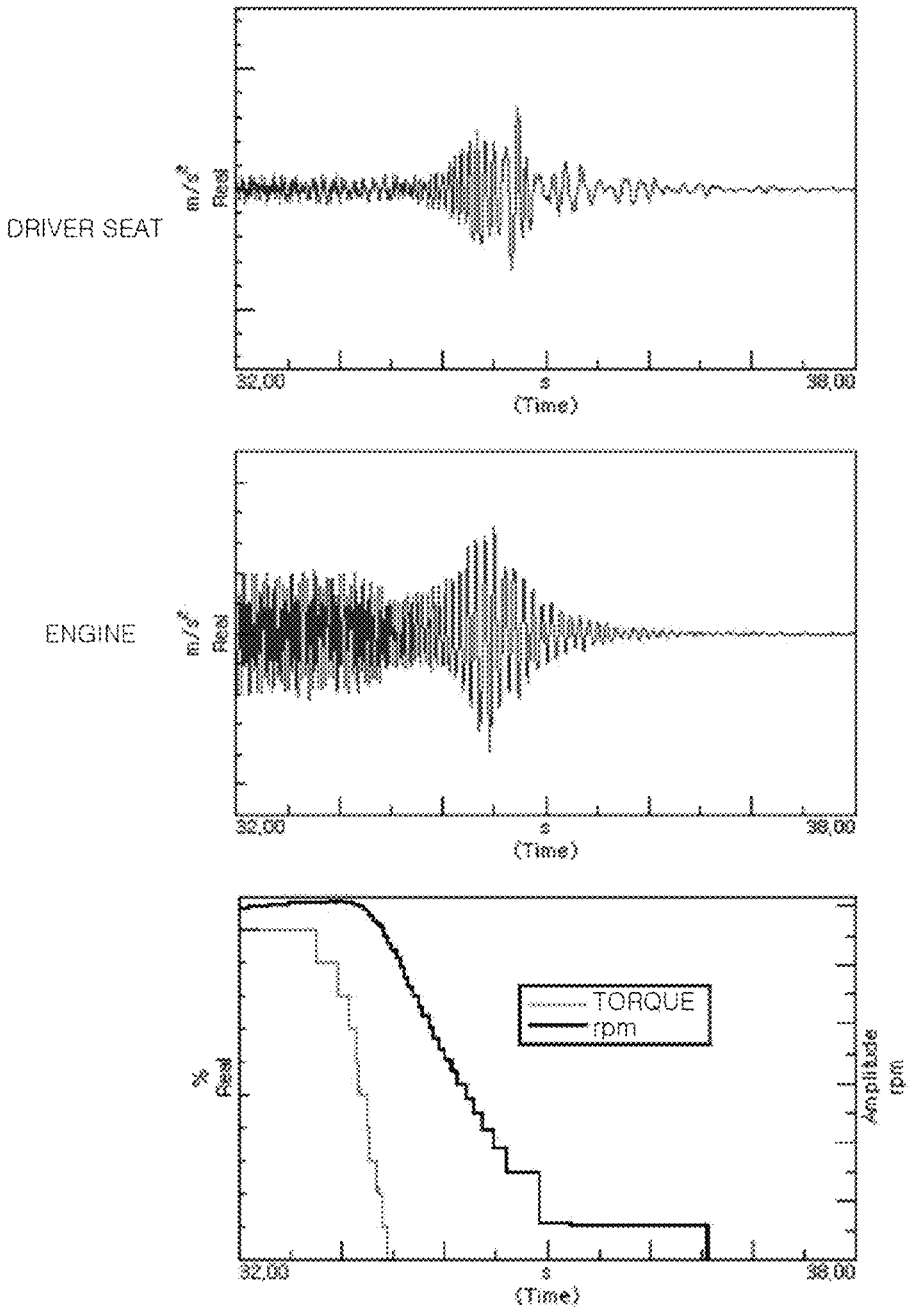
FIG. 9B is a graph illustrating the amount of vertical vibration in the driver seat and the engine of the vehicle upon the KEY-OFF of the engine when performing the vibration reduction control based on the timer for 500 ms time.
Figure 9C:
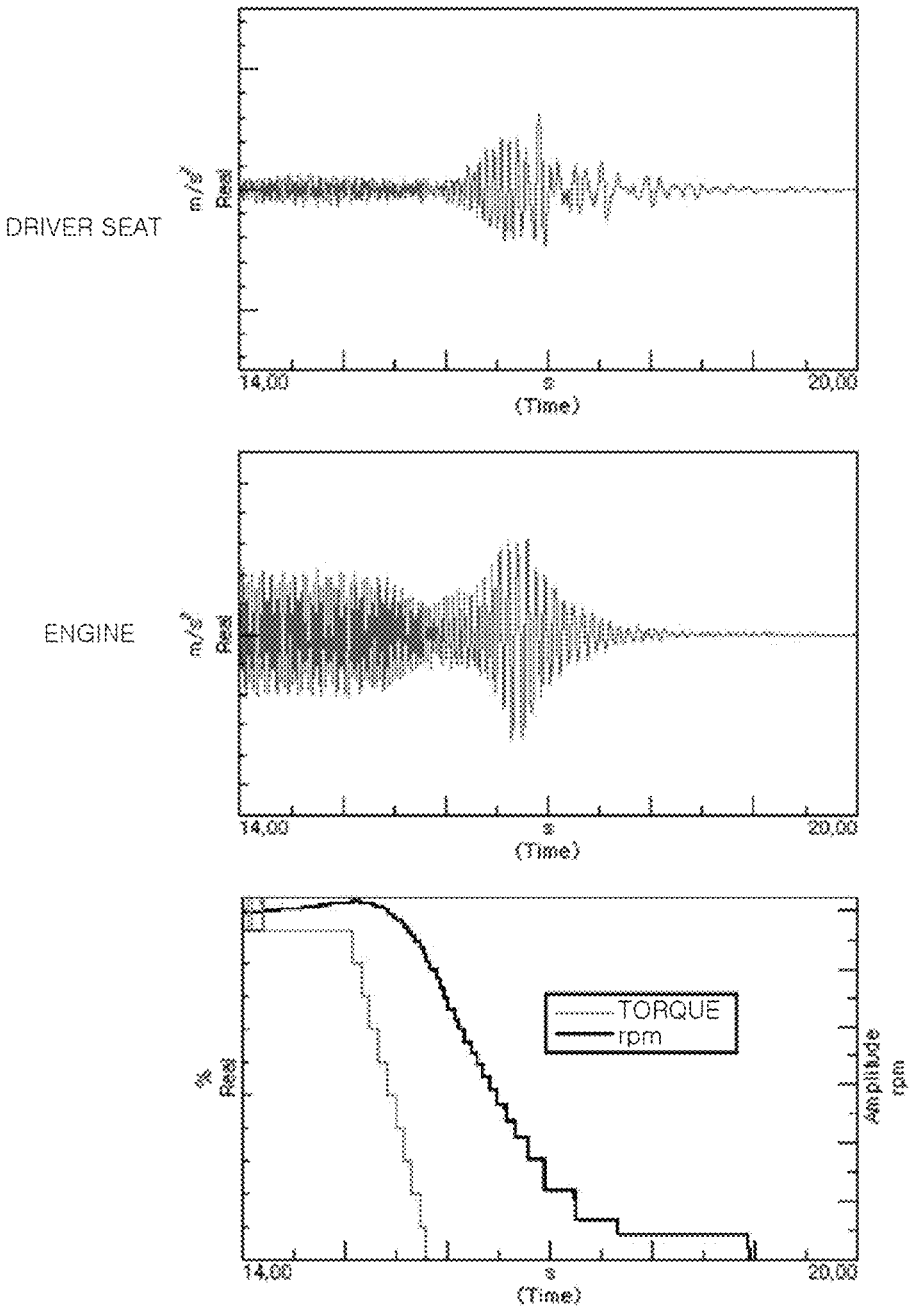
FIG. 9C is a graph illustrating the amount of vertical vibration in the driver seat and the engine of the vehicle upon the KEY-OFF of the engine when performing the vibration reduction control based on the timer for 800 ms time.
Figure 9D:
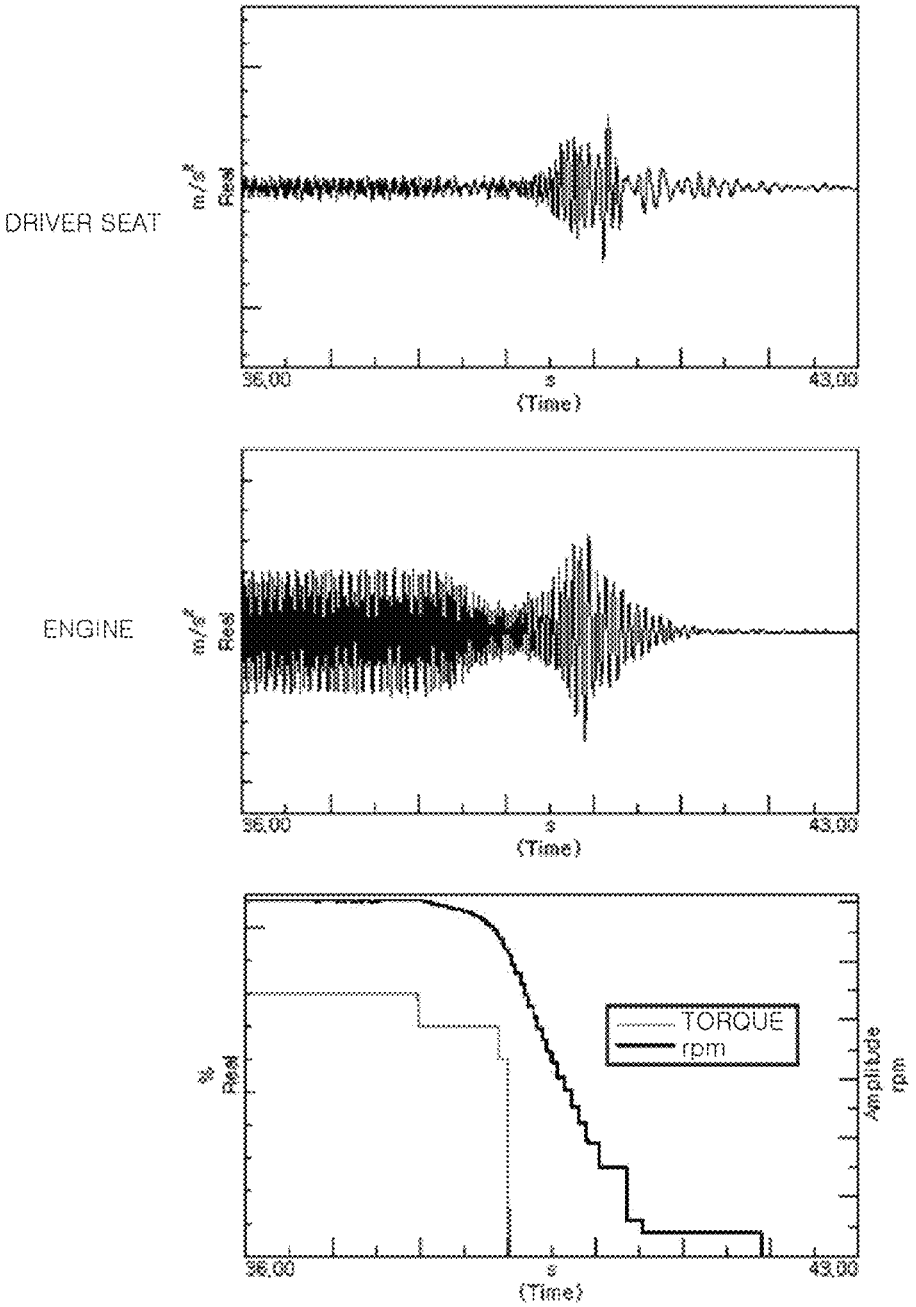
FIG. 9D is a graph illustrating the amount of vertical vibration in the driver seat and the engine of the vehicle upon the KEY-OFF of the engine when performing the vibration reduction control based on the RPM of the engine.

FIG. 9A is a graph illustrating the amount of vertical vibration in the driver seat and the engine of the vehicle upon the KEY-OFF of the engine before the vibration reduction control, and FIG. 9B is a graph illustrating the amount of vertical vibration in the driver seat and the engine of the vehicle upon the KEY-OFF of the engine when performing the vibration reduction control based on the timer for 500 ms time under the same condition. Furthermore, FIG. 9C is a graph illustrating the amount of vertical vibration in the driver seat and the engine upon the KEY-OFF of the engine when performing the vibration reduction control based on the timer for 800 ms time under the same conditions, and FIG. 9D is a graph illustrating the amount of vertical vibration in the driver seat and the engine upon the KEY-OFF of the engine when performing the vibration reduction control based on the RPM of the engine under the same conditions.

As illustrated in FIG. 9A, FIG. 9B, FIG. 9C, and FIG. 9D, by employing the vibration control method in accordance with various aspects of the present invention, not only the amount of lateral vibration generated in the engine and the vehicle body upon the KEY-OFF of the vehicle but also the amount of vertical vibration may be greatly reduced.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain predetermined principles of the invention and their practical application, to enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A vibration reduction device upon KEY-OFF of an engine, the vibration reduction device comprising:

a fuel injection device injecting fuel stored in a fuel tank into a combustion chamber of the engine depending upon a target torque value;

a measurement device configured of measuring a revolution per minute (RPM) and a rotational torque value of the engine; and an controller connected to the fuel injection device and the measurement device, wherein the controller determines when the engine is KEY-OFF, and wherein, when the controller determines that the engine is in KEY-OFF state, the controller sets a value reducing, at a predetermined rate, the rotational torque value of the engine measured by the measurement device upon the KEY-OFF, as the target torque value and controls the fuel injection device to inject fuel into the engine according to the target torque value, thereby reducing engine vibration.

2. The vibration reduction device upon the KEY-OFF of the engine of claim 1, wherein the controller performs a vibration reduction control based on the RPM of the engine, the vibration reduction control which sets as the target torque value a value reducing the rotational torque value of the engine measured upon the KEY-OFF at a predetermined rate depending upon the RPM of the engine measured from the measurement device.

3. The vibration reduction device upon the KEY-OFF of the engine of claim 1, wherein the controller performs a vibration reduction control based on a timer, the vibration reduction control which sets as the target torque value a value reducing the rotational torque value of the engine measured upon the KEY-OFF at a predetermined rate depending upon an elapsed time after the KEY-OFF of the engine.

4. The vibration reduction device upon the KEY-OFF of the engine of claim 2, wherein the controller measures the RPM of the engine upon the KEY-OFF of the engine by the measurement device, and when the measured RPM of the engine exceeds a predetermined reference value, performs the vibration reduction control.

5. The vibration reduction device upon the KEY-OFF of the engine of claim 1, wherein the controller performs a vibration reduction control based on the RPM of the engine, the vibration reduction control which sets as the target torque value a value reducing the rotational torque value of the engine measured upon the KEY-OFF at a predetermined rate depending upon the RPM of the engine until the RPM of the engine measured by the measurement device maintains more than a predetermined RPM, and wherein the controller performs a vibration reduction control based on a timer, the vibration reduction control which sets as the target torque value a value reducing a final target torque value set upon the vibration reduction control based on the RPM of the engine at a predetermined rate depending upon an elapsed time after the RPM of the engine is equal to or smaller than a predetermined RPM depending upon the vibration reduction control based on the RPM of the engine.

6. The vibration reduction device upon the KEY-OFF of the engine of claim 1, wherein the set target torque value is interpolated by a predetermined interpolation method and an injection control of the fuel is performed based on the interpolated target torque value to make a continuous control for injecting the fuel based on the interpolated target torque value.

7. The vibration reduction device upon the KEY-OFF of the engine of claim 1, wherein the controller confirms a setting value as to when a fuel injection stop timing is delayed upon the KEY-OFF; when fuel injection stop timing is set to be delayed, performs the vibration reduction control of the engine before stopping the engine; and when it is set to be unable to delay the fuel injection stop timing, sets a target torque amount to zero and stops fuel supply to stop the engine.

8. The vibration reduction device upon the KEY-OFF of the engine of claim 1, wherein the controller is configured to not perform the vibration reduction control of the engine when a failure of the fuel injection device is diagnosed, by the controller to occur, and sets a target torque amount to zero and stops fuel supply to stop the engine.

9. The vibration reduction device upon the KEY-OFF of the engine of claim 1, wherein the controller determines when a power take-off device disposed on a transmission of a vehicle is in use upon the KEY-OFF;

wherein when the power take-off device is in use, the controller does not perform the vibration reduction control of the engine; and sets a target torque amount to zero and stops fuel supply to stop the engine.

10. A vibration reduction method upon KEY-OFF of an engine, the vibration reduction method comprising:

determining, by a controller, when the engine is KEY-OFF;

measuring, by a measurement device, a rotational torque value of the engine upon the KEY-OFF of the engine when the KEY-OFF of the engine is determined by the controller;

setting, by the controller, a value reducing the rotational torque value of the engine at a predetermined rate, as a target torque value, wherein the rotational torque value of the engine is measured by the measurement device upon the KEY-OFF; and controlling, by the controller, a fuel injection device to inject fuel after the KEY-OFF of the engine according to the set target torque value.

11. The vibration reduction method upon the KEY-OFF of the engine of claim 10, wherein the setting of the target torque value includes:

measuring a revolution per minute (RPM) of the engine using the measurement device connected to the controller; and setting as the target torque value the value reducing the rotational torque value of the engine measured upon the KEY-OFF at a predetermined rate depending upon the RPM of the engine, wherein injection control of the fuel is performed until the target torque value set depending upon the RPM of the engine is a predetermined value.

12. The vibration reduction method upon the KEY-OFF of the engine of claim 10, wherein the setting of the target torque value includes:

counting an elapsed time after the KEY-OFF; and setting as the target torque value a value reducing the rotational torque value of the engine measured upon the KEY-OFF at a predetermined rate depending upon the counted elapsed time, and wherein injection control of the engine is performed until the target torque value set depending upon the counted elapsed time after the KEY-OFF is a predetermined value.

13. The vibration reduction method upon the KEY-OFF of the engine of claim 10, wherein the setting of the target torque value includes:

measuring the RPM of the engine using the measurement device connected to the controller; and measuring the RPM of the engine upon the KEY-OFF of the engine by the measurement device and setting as the target torque value a value reducing the rotational torque value of the engine measured upon the KEY-OFF at a predetermined rate depending upon the measured RPM of the engine when the measured RPM of the engine exceeds a predetermined reference value, and wherein injection control of the engine is performed based on the set target torque value until the target torque value set depending upon the RPM of the engine is a predetermined value.

14. The vibration reduction method upon the KEY-OFF of the engine of claim 10, wherein the setting of the target torque value includes:

measuring the RPM of the engine using the measurement device connected to the controller;

measuring the RPM of the engine upon the KEY-OFF of the engine by the measurement device and counting an elapsed time after the KEY-OFF when the measured RPM of the engine is equal to or smaller than a predetermined reference value; and setting as the target torque value a value reducing the rotational torque value of the engine measured upon the KEY-OFF at a predetermined rate depending upon the counted elapsed time, and wherein injection control of the engine is performed based on the set target torque value until the target torque value set depending upon the counted elapsed time after the KEY-OFF is a predetermined value.

15. The vibration reduction method upon the KEY-OFF of the engine of claim 10, wherein the setting of the target torque value includes:

measuring the RPM of the engine using the measurement device connected to the controller;

setting as the target torque value a value reducing the rotational torque value of the engine measured upon the KEY-OFF at a predetermined rate depending upon the measured RPM of the engine until the RPM of the engine is equal to or smaller than a predetermined reference value; and setting as the target torque value a value reducing the target torque value finally set previously at a predetermined rate depending upon an elapsed time from when the RPM of the engine is equal to or smaller than the predetermined reference value, and wherein injection control of the engine is performed based on the set target torque value until the target torque value set after the KEY-OFF is a predetermined value.

16. The vibration reduction method upon the KEY-OFF of the engine of claim 10, further including performing an injection control of the fuel based on an interpolated target torque value after interpolating the set target torque value by a predetermined interpolation method.

17. The vibration reduction method upon the KEY-OFF of the engine of claim 10, further including determining when a fuel injection stop timing is delayed upon the KEY-OFF, wherein, when the controller determines that the fuel injection stop timing is unable to be delayed upon the KEY-OFF, a target torque amount is set to zero and fuel supply is stopped to stop the engine.

18. The vibration reduction method upon the KEY-OFF of the engine of claim 17, wherein, when a failure in the fuel injection device has occurred or a power take-off device disposed on a transmission of a vehicle upon the KEY-OFF is in use, the controller determines that the fuel injection stop timing is unable to be delayed.

* * * * *